US011432652B2

(12) United States Patent
DuPré

(10) Patent No.: US 11,432,652 B2
(45) Date of Patent: Sep. 6, 2022

(54) NECK PILLOW WITH REMOVABLE AND CONFIGURABLE INSERT

(71) Applicant: Michelle DuPré, Brooklyn, NY (US)

(72) Inventor: Michelle DuPré, Brooklyn, NY (US)

(73) Assignee: Tandem Goods LLC, Los Angeles, CA (US)

( * ) Notice: Subject to any disclaimer, the term of this patent is extended or adjusted under 35 U.S.C. 154(b) by 178 days.

(21) Appl. No.: 16/724,627

(22) Filed: Dec. 23, 2019

(65) Prior Publication Data

US 2020/0214452 A1 Jul. 9, 2020

Related U.S. Application Data

(60) Provisional application No. 62/788,284, filed on Jan. 4, 2019.

(51) Int. Cl.
*A47C 7/38* (2006.01)
*A47G 9/10* (2006.01)

(52) U.S. Cl.
CPC ..... *A47C 7/383* (2013.01); *A47G 9/1081* (2013.01); *A47G 2009/1018* (2013.01)

(58) Field of Classification Search
CPC ..... A47C 7/383; A47G 9/10; A47G 9/1027; A47G 9/1045; A47G 9/1081; A47G 9/1072; A47G 9/109; A47G 2009/1018
See application file for complete search history.

(56) References Cited

U.S. PATENT DOCUMENTS 3,633,227 A * 1/1972 Tegeler ..... A47G 9/086 5/413 R
3,667,074 A 6/1972 Emery
5,099,530 A * 3/1992 Scott ..... A47G 9/02 5/419
5,313,678 A * 5/1994 Redewill ..... A47C 21/003 297/393
5,790,999 A * 8/1998 Clark ..... A47D 13/083 5/633
6,223,367 B1 * 5/2001 French ..... A45C 3/10 383/4

(Continued)

FOREIGN PATENT DOCUMENTS

WO WO2018072645 A1 4/2018

*Primary Examiner* — Peter M. Cuomo
*Assistant Examiner* — Rahib T Zaman
(74) *Attorney, Agent, or Firm* — Lombard & Geliebter LLP; Eric J. Huang

(57) ABSTRACT

A pillow that includes a substantially u-shaped pillow body having a medial region and a pair of legs that extend from the medial region to define an opening therebetween. The pillow body includes a casing defining an exterior surface and interior surface of the pillow body. The interior surface defines a lumen of the pillow body, and the lumen is a single continuous interior compartment. The pillow body includes an interior core disposed within the lumen. The interior core may include a flexible insert in a rolled up configuration that substantially fills the interior core. The casing may include a top fabric member, a bottom fabric member, and a middle fabric section that runs along the curved outer periphery and curved inner periphery of the casing, and is attached to the top fabric member and bottom fabric member.

15 Claims, 17 Drawing Sheets

(56) References Cited

U.S. PATENT DOCUMENTS 6,363,554 B1 * 4/2002 Brown ..... A47G 9/0253 5/490
6,532,611 B1 3/2003 Day
7,628,456 B1 * 12/2009 Swartz ..... A47C 7/383 297/393
7,657,954 B1 * 2/2010 Bunkers ..... A42B 1/048 5/644
7,900,303 B2 * 3/2011 Mastrosimone-Gese ..... A47D 13/083 5/655
8,321,977 B1 * 12/2012 Kummerfeld ..... A47C 27/086 5/636
8,490,230 B2 * 7/2013 Rovin ..... A47D 5/006 5/655
8,887,333 B2 * 11/2014 Cohen ..... A47C 27/081 5/639
10,390,623 B2 * 8/2019 Konigsberg ..... A47G 9/066
10,863,826 B1 * 12/2020 Schneider ..... A47C 7/383
11,039,699 B1 * 6/2021 Leach ..... A47G 9/1072
2007/0271703 A1 * 11/2007 Matthews Brown ..... A47D 15/003 5/636
2009/0133192 A1 * 5/2009 Hassell ..... A47G 9/064 5/639
2012/0073056 A1 * 3/2012 Freund ..... A47G 9/10 5/639
2013/0125312 A1 * 5/2013 Harooni ..... A47C 7/383 5/639
2014/0007351 A1 * 1/2014 Cohen ..... A47G 9/0253 5/639
2014/0196214 A1 7/2014 DuPré
2014/0283303 A1 * 9/2014 Rochlin ..... A47G 9/10 5/636
2015/0257554 A1 * 9/2015 Ross ..... A47G 9/066 5/639
2017/0055738 A1 3/2017 Sternlight et al.
2018/0184820 A1 * 7/2018 Johnson ..... A47G 9/109

* cited by examiner

NECK PILLOW WITH REMOVABLE AND CONFIGURABLE INSERT

CROSS-REFERENCE TO RELATED APPLICATION

The present application claims priority to U.S. Provisional Patent Application No. 62/788,284, filed Jan. 4, 2019, which is incorporated herein by reference.

FIELD OF THE APPLICATION

The present application relates generally to head and neck support pillows and equivalent resilient products, and more particularly to a head and neck support pillow that includes a casing and an interior core composed of a removable modular configurable pillow case insert operable in two configurations.

BACKGROUND OF THE APPLICATION

Many head and neck pillows exist, but few are configurable for use in varying situations. For example, U-shaped travel pillows may be used, as the name implies, while traveling and while sitting in a relative upright position. These types of pillows, however, are of limited use in a laying position and cannot be reconfigured to be also used as a memory foam pillow topper. Accordingly, there is a need for a configurable pillow that is much more versatile that the pillows in the art, specifically a neck pillow containing a removable modular configurable pillow case insert that is also operable as a memory foam pillow topper.

SUMMARY OF THE APPLICATION

The present application addresses and resolves one or more of the disadvantages of the previously known head and neck support pillows or pillow cases, as well as of most travel and/or specialty pillow products, by providing, in various exemplary embodiments thereof, a head and neck support pillow that includes a casing and an interior core composed of a modular removable configurable pillow case insert operable in two configurations, where the first configuration of the modular configurable pillow case is in a rolled up, substantially cylindrical form readily suitable for insertion into the casing of a head and neck support pillow, and where in the second configuration of the modular configurable pillow case—which is discussed in U.S. Pat. No. 9,247,836, the disclosure of which is hereby incorporated by reference in its entirety—is an unrolled form, where the configurable pillow case insert includes an internally disposed primary compartment (for receiving a primary resilient insert component (e.g., a conventional pillow or equivalent), and at least one secondary compartment, positioned proximally to (e.g., above and/or below) the pillow case top surface, that is sized and configured to receive, and releaseably retain therein, one or more correspondingly sized and configured secondary insert component(s) that are each operable to provide one or more predefined desirable physical characteristics or properties to the resulting "pillow assembly" (such as memory foam region as a "topper" to a conventional pillow), and/or that add to, augment, enhance, and/or otherwise supplement, the characteristics or properties offered by the primary resilient insert, and that are configurable to further provide one or more additional functions and features (including, by way of example, "technological" functions or features, such as noise cancellation, ambient music playback, alarms, lighting, etc.).

Advantageously, the modular configurable pillow case insert of the neck pillow disclosed herein is operable in two configurations, where the first configuration of the modular configurable pillow case is a rolled up, substantially cylindrical form, with the primary resilient insert removed therefrom, readily suitable for insertion into the casing of a head and neck support pillow, and where the second configuration of the modular configurable pillow case is an unrolled form operable to enable the use in conjunction with a pillow (or equivalent product) inserted therein, as a memory foam pillow topper.

In one embodiment, a pillow is provided that includes a substantially u-shaped pillow body having a medial region and a pair of legs that extend from the medial region to define an opening therebetween. The pillow body includes a casing defining an exterior surface and interior surface of the pillow body. The interior surface defines a lumen of the pillow body, and the lumen is a single continuous interior compartment. The pillow body includes an interior core disposed within the lumen. The interior core includes a flexible insert in a rolled up configuration that substantially fills the interior core.

In another embodiment, the flexible insert includes at least one of: a memory foam component, a latex foam component, a memory gel component, a granular mixture, at least one inflatable bladder, a rubberized component, a selectively shapeable component, a feather filled component, a down filled component, and a resilient material component or assembly.

In another embodiment, the flexible insert includes a configurable pillow case insert that includes a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

In another embodiment, the primary insert includes a conventional pillow and the at least one secondary insert includes at least one of: a memory foam component, a latex foam component, a memory gel component, a granular mixture, at least one inflatable bladder, a rubberized component, a selectively shapeable material component, a feather filled component, a down filled component, and a resilient material component or assembly.

In another embodiment, the pillow body includes an opening on the casing through which the lumen is accessible and into which the flexible insert may be received and releasably retained therein.

In another embodiment, the casing is configured to substantially maintain the substantially u-shape of the pillow body after the flexible insert has been inserted therein.

In another embodiment, the flexible insert, when in a rolled up configuration, is generally cylindrical shaped before it is received by the lumen.

In another embodiment, the casing defines a top side, a bottom side, a curved outer periphery, and a curved inner periphery of the pillow body. The casing includes a top fabric member on the top side of the casing, where the top fabric member has a first edge, a bottom fabric member on the bottom side of the casing, where the bottom fabric member has a second edge and the top and bottom fabric members are both substantially u-shaped and substantially the same size, and a middle fabric section having a top edge and a bottom edge, where the middle fabric section runs along the curved outer periphery and curved inner periphery of the casing, and is attached along the top edge to the first edge of the top fabric member, and attached along the bottom edge to the second edge of the bottom fabric member.

In another embodiment, the middle fabric section includes: a first, second, third and fourth rectangular fabric members. The first rectangular fabric member runs along the curved inner periphery of the casing between the legs. The second and third rectangular fabric members are adjacent to, and attached to, the first rectangular fabric member, and run along the curved outer periphery of the casing between the medial region and the curved inner periphery, each along a respective leg. The fourth rectangular fabric member is adjacent to, and attached to, the second and third rectangular fabric members, and runs along the medial region.

In another embodiment, a pillow is provided that includes a substantially u-shaped pillow body having a medial region and a pair of legs that extend from the medial region to define an opening therebetween. The pillow body includes a casing defining an exterior surface and interior surface of the pillow body. The interior surface defines a lumen of the pillow body, and the lumen is a single continuous interior compartment. The casing defines a top side, a bottom side, a curved outer periphery, and a curved inner periphery of the pillow body. The casing includes a top fabric member on the top side of the casing, where the top fabric member has a first edge, a bottom fabric member on the bottom side of the casing, where the bottom fabric member has a second edge and the top and bottom fabric members are both substantially u-shaped and substantially the same size, and a middle fabric section having a top edge and a bottom edge, where the middle fabric section runs along the curved outer periphery and curved inner periphery of the casing, and attached along the top edge to the first edge of the top fabric member, and is attached along the bottom edge to the second edge of the bottom fabric member. The pillow body includes an interior core disposed within the lumen. The interior core includes a resilient material component that substantially fills the interior core.

In another embodiment, the middle fabric section includes a first, second, third, and fourth rectangular fabric members. The first rectangular fabric member runs along the curved inner periphery of the casing between the legs. The second and third rectangular fabric members are adjacent to, and attached to, the first rectangular fabric member, and runs along the curved outer periphery of the casing between the medial region and the curved inner periphery, each along a respective leg. The fourth rectangular fabric member is adjacent to, and attached to, the second and third rectangular fabric members, and runs along the medial region.

In another embodiment, the resilient material component includes a flexible insert in a rolled up configuration.

In another embodiment, the flexible insert includes at least one of: a memory foam component, a latex foam component, a memory gel component, a granular mixture, at least one inflatable bladder, a rubberized component, a selectively shapeable component, a feather filled component, a down filled component, and a resilient material component or assembly.

In another embodiment, the flexible insert includes a configurable pillow case insert that includes a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

In another embodiment, the primary insert includes a conventional pillow and the at least one secondary insert includes at least one of: a memory foam component, a latex foam component, a memory gel component, a granular mixture, at least one inflatable bladder, a rubberized component, a selectively shapeable material component, a feather filled component, a down filled component, and a resilient material component or assembly.

In another embodiment, the pillow body includes an opening on the casing through which the lumen is accessible and into which the flexible insert may be received and releasably retained therein.

In another embodiment, the casing is configured to substantially maintain the substantially u-shape of the pillow body after the flexible insert has been inserted therein.

In another embodiment, the flexible insert, when in a rolled up configuration, is generally cylindrical shaped before it is received by the lumen.

In another embodiment, a pillow is provided that includes a substantially u-shaped pillow body having a medial region and a pair of legs that extend from the medial region to define an opening therebetween. The pillow body includes a casing defining an exterior surface and interior surface of the pillow body, the interior surface defining a lumen of the pillow body, and the lumen is a single continuous interior compartment. The casing defines a top side, a bottom side, a curved outer periphery, and a curved inner periphery of the pillow body. The. casing includes a top fabric member on the top side of the casing, where the top fabric member has a first edge, a bottom fabric member on the bottom side of the casing, where the bottom fabric member has a second edge and the top and bottom fabric members are both substantially u-shaped and substantially the same size, and a middle fabric section having a top edge and a bottom edge, where the middle fabric section runs along the curved outer periphery and curved inner periphery of the casing, and is attached along the top edge to the first edge of the top fabric member, and attached along the bottom edge to the second edge of the bottom fabric member. The pillow body includes an interior core disposed within the lumen. The interior core includes a flexible insert in a rolled up configuration that substantially fills the interior core.

In another embodiment, the flexible insert includes at least one of: a memory foam component, a latex foam component, a memory gel component, a granular mixture, at least one inflatable bladder, a rubberized component, a selectively shapeable component, a feather filled component, a down filled component, a resilient material component or assembly, and a configurable pillow case insert. The configurable pillow case insert includes a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

Furthermore, the various exemplary embodiments disclosed in the present application may readily and advantageously utilize any number and/or combination of wide variety of possible features, that each provide one or more specific beneficial/desirable characteristics, properties, functions, and/or features to the configurable pillow case assembly.

Other objects and features of the disclosures of the present application will become apparent from the following detailed description considered in conjunction with the accompanying drawings. It is to be understood, however, that the drawings are designed solely for purposes of illustration and not as a definition of the limits of the invention, for which reference should be made to the appended claims.

BRIEF DESCRIPTION OF THE DRAWINGS

In the drawings, where like reference characters denote corresponding or similar elements throughout the various figures:

FIG. 7D-1 is a schematic isometric view diagram of the exemplary embodiment of the configurable pillow case of FIG. 7C.

FIG. 7D-2 is a schematic isometric view diagram of an alternative embodiment of the configurable pillow case of FIG. 7C.

FIG. 7D-3 is a schematic isometric view diagram of the exemplary embodiment of the configurable pillow case of FIG. 7D-1, shown, by way of example only, in its rolled-up mode, and positioned within an optional outer housing.

DETAILED DESCRIPTION OF PREFERRED EMBODIMENTS

In various exemplary embodiments thereof, the head and neck pillow of the present application addresses and resolves one or more of the flaws and drawbacks of previously known head and neck pillows as well as the drawbacks, flaws, and deficiencies of most travel and/or specialty pillow products, while at the same time providing significant additional benefits and advantages.

The present application is directed to head and neck support pillows generally having a casing containing an interior core composed of a modular configurable pillow case insert operable in two configurations, where the first configuration of the modular configurable pillow case is in a rolled up, substantially cylindrical form readily suitable for insertion into the casing of a head and neck support pillow, and where the second configuration of the modular configurable pillow case is in an unrolled form operable to enable the use, in conjunction with a pillow (or equivalent product) inserted therein, of one or more resilient components that provide one or more predefined desirable physical characteristics or properties (such as, for example memory foam capabilities) to a resulting "configurable pillow case assembly", that are usable or operable to add to, augment, enhance, and/or otherwise supplement, the characteristics or properties offered by the inserted pillow, and that are optionally configurable to further provide the configurable pillow case assembly with one or more additional selectively operable and/or automated functions and features.

Figure 1:
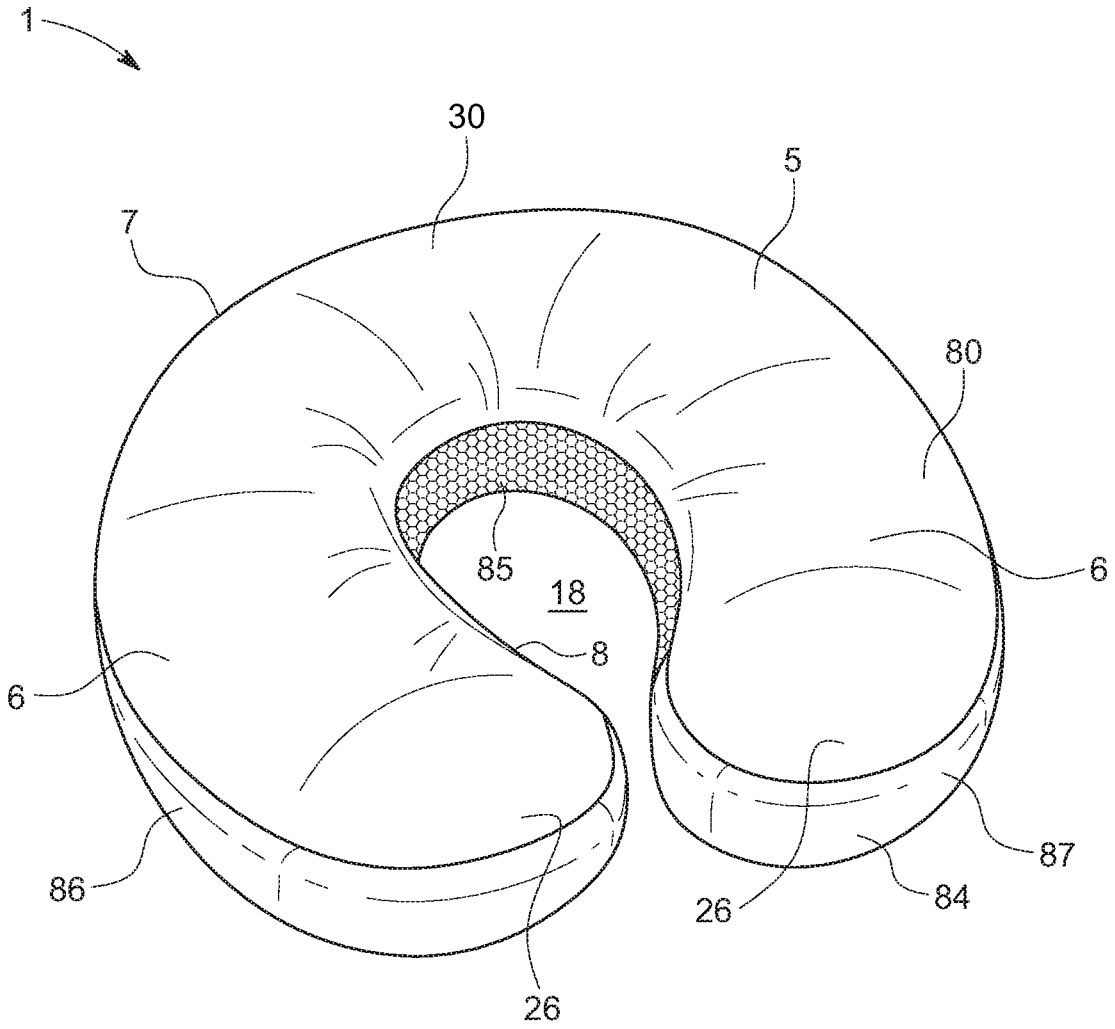
FIG. 1 is a front perspective view of the exterior of the neck pillow in accordance with an exemplary embodiment of the application.

Referring now to FIG. 1, a first exemplary embodiment for the head and neck pillow (hereinafter "neck pillow") 5 is shown. The neck pillow 5 is configured in a semi-circular or U-shape, for receiving and cradling the head and neck of a user. The neck pillow 5 comprises a pillow body 10 having two legs 20 and a medial portion 30 to form a single unitary piece. The body 10 defines a curved outer periphery 12 that is rounded in both a longitudinal and a lateral direction. The body 10 further includes a curved central inner periphery 14 that defines a rounded, generally circular or elliptical opening 18. The two legs 20 join with the medial region 30 and form the opening 18 between them and where they join the medial region 30. Thus, the opening 18 is defined by the space between the legs 20 and the medial region 30 of the pillow body 10. The opening 18 is the space where the head and neck of a user is received. The opening 18 is configured to receive the head and neck of a user sufficiently closely to hold the pillow body 10 in position while the user is sitting in repose. The leg portions 20 have distal end portions 26 that come together.

Figure 2:
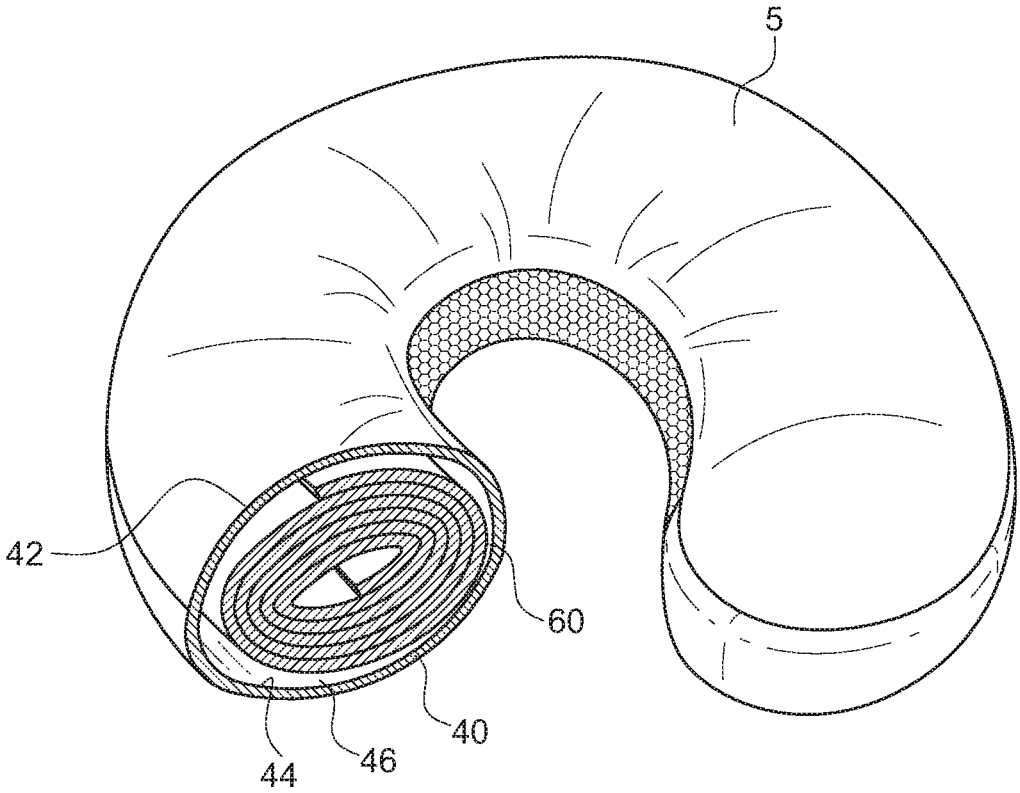
FIG. 2 is a perspective cross-section of the neck pillow body showing the interior compartment in accordance with an exemplary embodiment of the application.

Referring now to FIG. 2, the interior compartment of the pillow body 10 is shown. The pillow body 10 comprises a casing 40 and an interior core 60. The casing 40 has an exterior surface 42 that defines the exterior surface of the pillow body 10. The interior surface 44 of the casing 40 defines the interior space or lumen 46 of the pillow body 10. The lumen 46 is a single, continuous compartment without partition which contains the interior core 60. When the lumen 46 is substantially filled with the interior core 60, the pillow body has a relatively circular or elliptical cross section.

In a preferred embodiment, the interior core 60 is a configurable pillow case insert 10, 10A, or 10B as shown in FIGS. 7-12, and as shown specifically in a rolled-up configuration in FIG. 7D-1 and described below. Optionally, the configurable pillow case 10 further includes at least one releasable securing element 28 (e.g., an elastic, Velcro, or other type of a band or a strap) operable to maintain the configurable pillow case 10 in the rolled-up mode. The interior core may be any insert that includes a resilient material, including but not limited to, memory foam, Styrofoam beads, microbeads, etc. The interior core may be a single object, such as a single-piece memory foam insert, and more particularly the configurable pillow case insert 10 in a rolled-up configuration as shown in FIG. 7D-1 and described below, or a fill material that includes multiple objects, such as microbeads, feathers, etc. The fill material can be any of a variety of fibrous or fluent materials selectable by the ordinary skilled artisan for stuffing in a pillow. It is intended that the fill material be biologically inert to reduce the opportunity for the growth of germs, molds or fungi on the fill material. Also, it is intended that the fill material be washable and/or replaceable by the user. Appropriate biologically inert fill materials include polystyrene, polyester, and similar man-made materials.

Figure 7A:
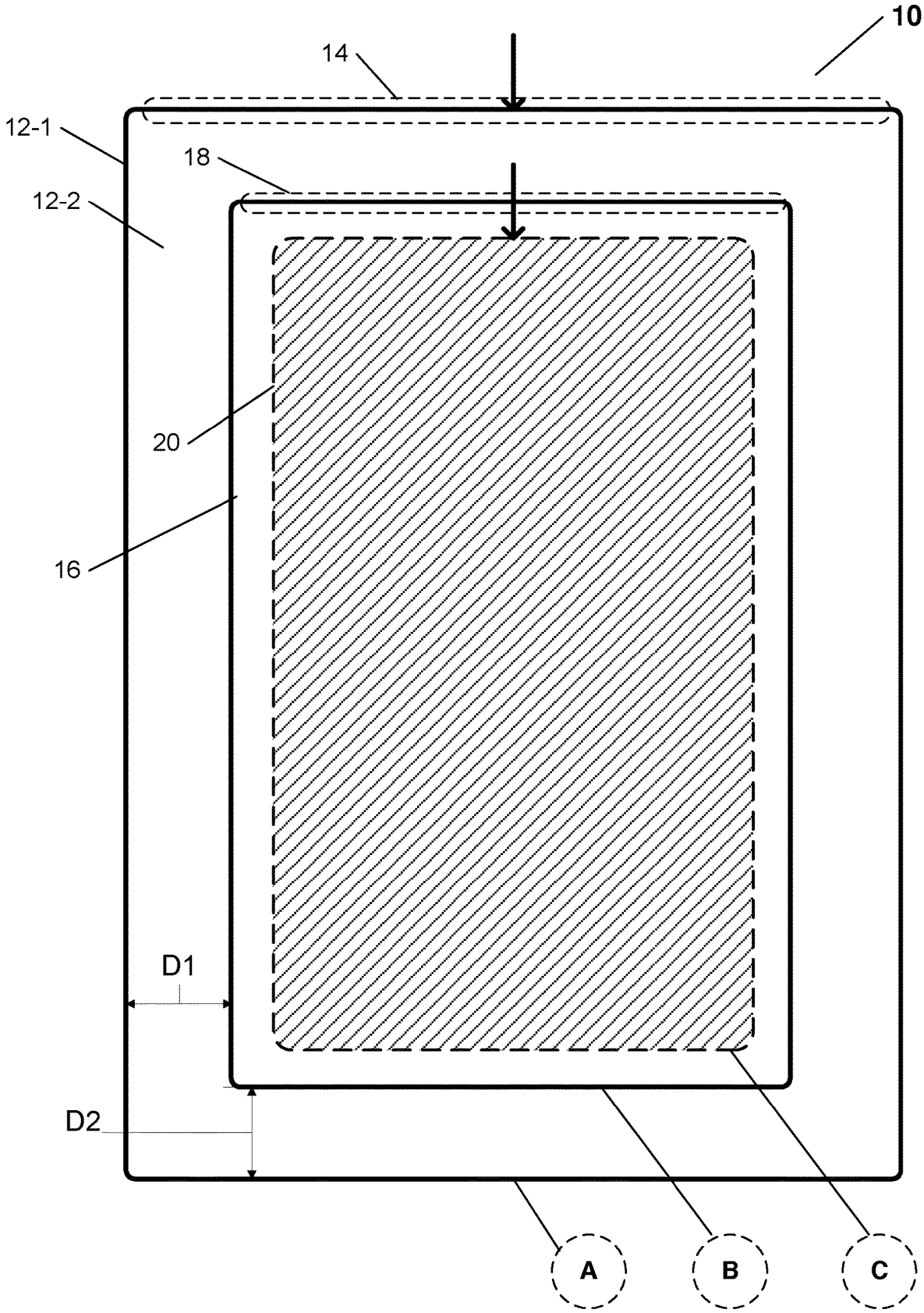
FIG. 7A is a schematic top-down view diagram of a first exemplary embodiment of the configurable pillow case.
Figure 7B:
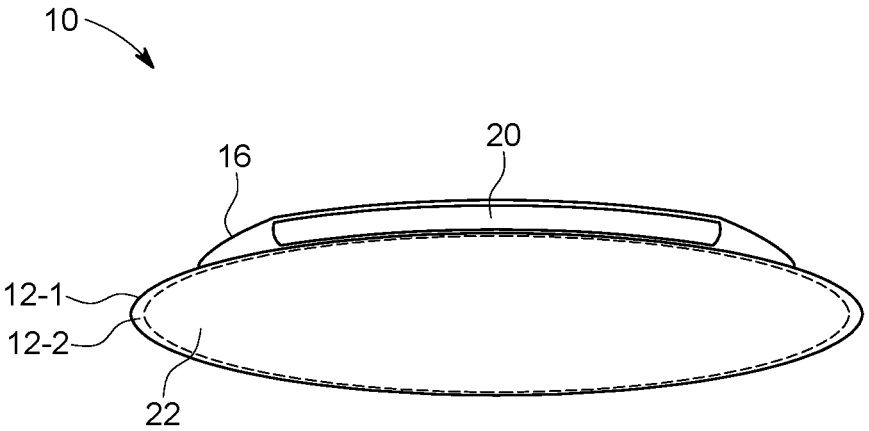
FIG. 7B is a schematic side view diagram of the exemplary embodiment of the configurable pillow case of FIG. 7A.
Figure 7C:
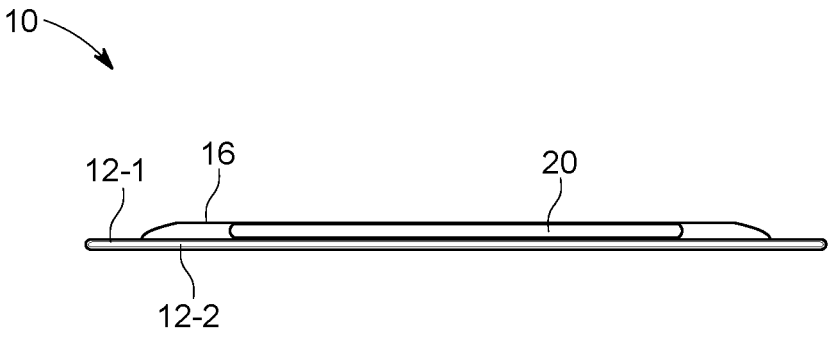
FIG. 7C is an alternative schematic side view diagram of the exemplary embodiment of the configurable pillow case of FIGS. 7A and 7B.
Figures 1, 7D:
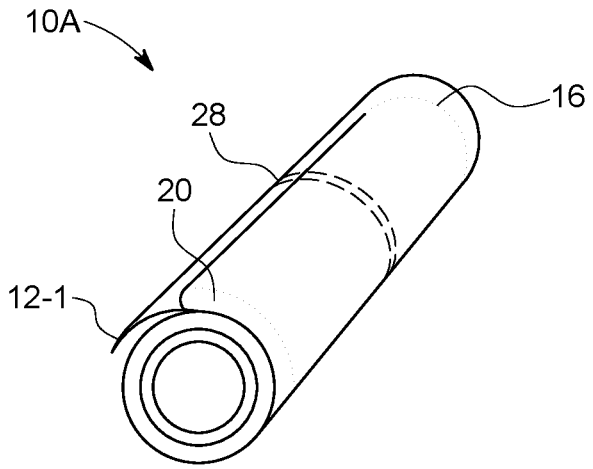
Figures 2, 7D:
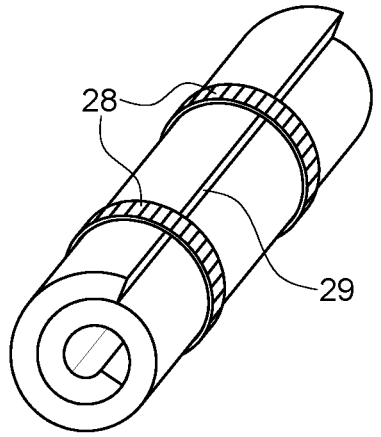

In an alternative preferred embodiment, the interior core may be a single-piece memory foam insert which may be enclosed in a muslin or thin fabric casing, as show specifically in a rolled-up configuration in FIG. 7D-2. Optionally, the single-piece memory foam insert further includes at least one releasable securing element 28 (e.g., an elastic, Velcro, or other type of a band or a strap) on the casing operable to maintain the single-piece memory foam insert in the rolled-up mode. Optionally, one bottom side edge 29 of the single-piece memory foam insert is further lined with a strip of Velcro hook or other fastening material to secure the rolled-up insert to itself at the edge 29. A corresponding Velcro loop strip may be attached to the casing at the appropriate location to mate with the hook strip or the hook strip may mate with the casing fabric directly.

In an alternative preferred embodiment, the interior core may comprise at least one of the following materials: memory foam, latex foam, memory gel, gel, fluid, a granular mixture, at least one inflatable air bladder, a rubberized component, a selectively shapeable material component (for example, pluckable soft foam), a feather filled component, a down filled component, and/or a resilient material component or assembly.

Figure 3A:
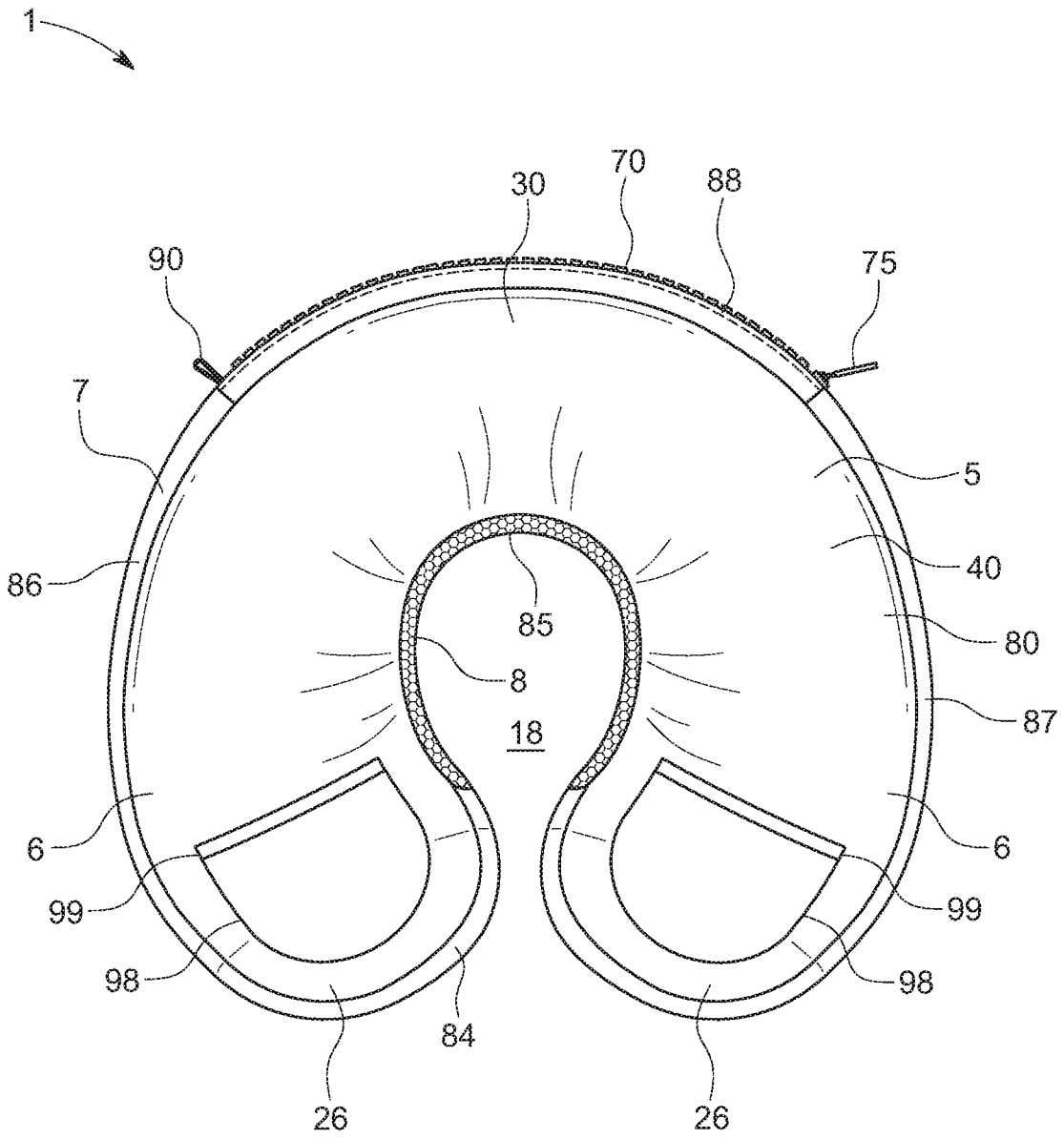
FIG. 3A is a top view of the neck pillow in accordance with an exemplary embodiment of the application.
Figure 3B:
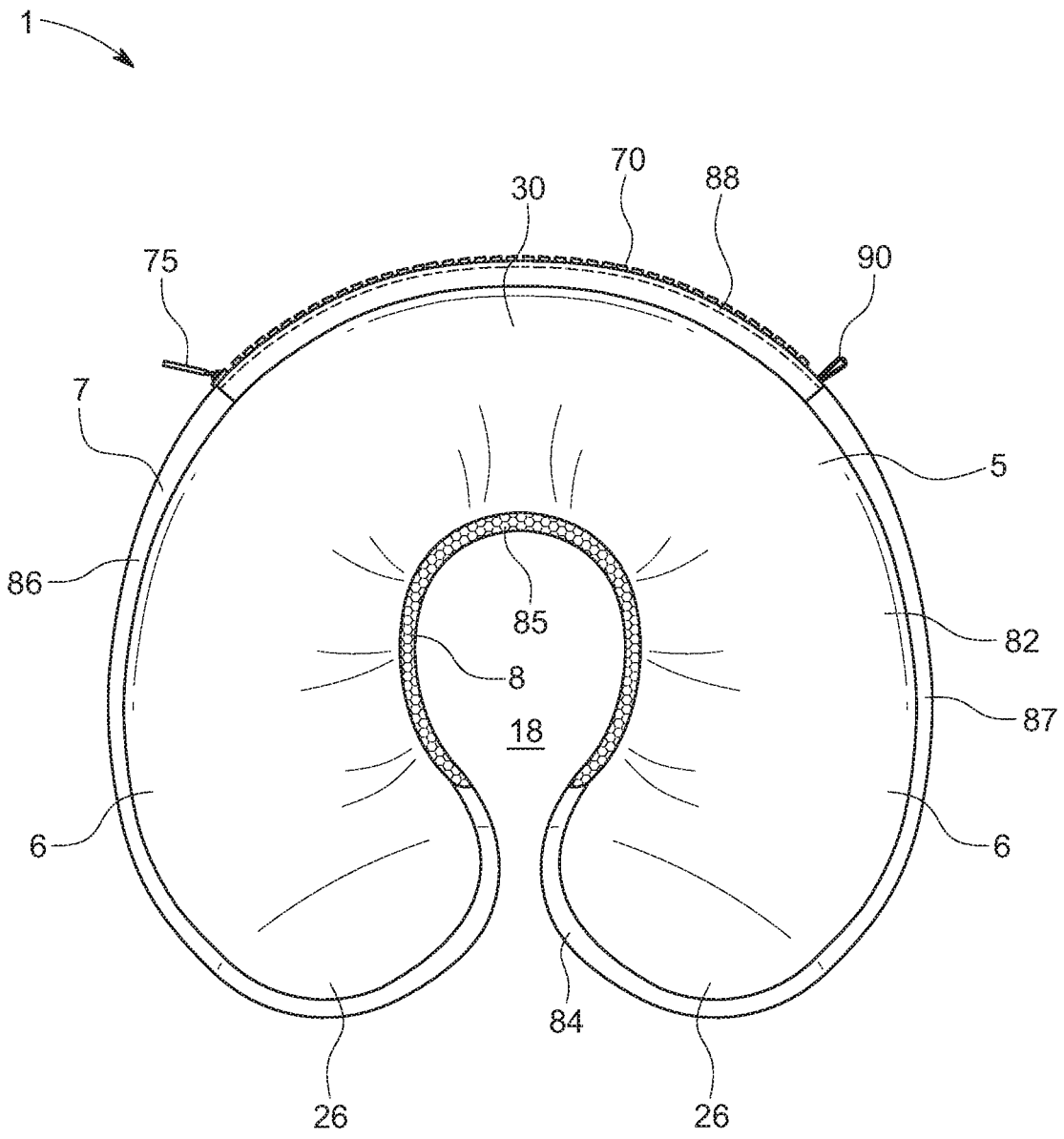
FIG. 3B is a rear view of the neck pillow in accordance with an exemplary embodiment of the application.
Figure 4:
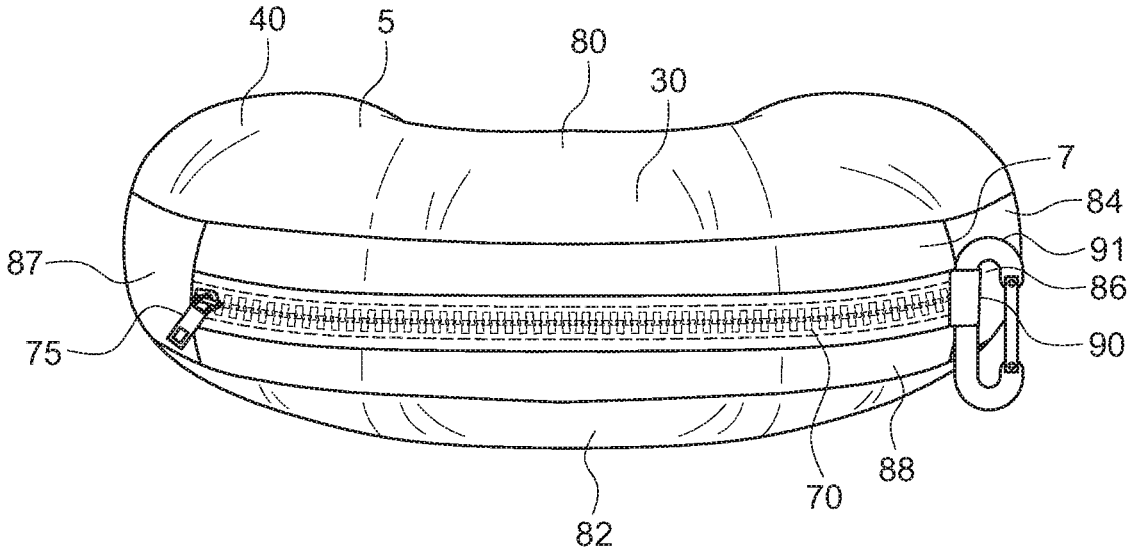
FIG. 4 is a top view of the neck pillow in accordance with an exemplary embodiment of the application.

Referring now to FIGS. 3A and 3B, which are a top and bottom view, respectively, of the neck pillow 5 in accordance with an exemplary embodiment of the application, and FIG. 4, which is a rear view of the neck pillow in accordance with an exemplary embodiment of the application, an opening 70 is provided on the pillow casing 40 along the curved outer periphery 12 of the medial region 30 of the rear of the pillow body 10. The opening 70 provides access to the lumen/interior space 46 of the pillow body 10 and further provides a means for inserting or removing the interior core 60 from the lumen/interior space. The opening 70 is made reversibly closable by a fastener means 75, such as a zipper, buttons, snaps, laces, Velcro, or any of a number of means known to one of ordinary skill in the art. When the fastener is closed, the interior core 60 remains fixed inside the lumen. When the fastener is opened, the interior core 60 may be removed from, or inserted into, the lumen 46.

A loop 90 is provided on the pillow casing 40 at one end of the opening 70. The loop may contain an attaching element 91, such as a hook or carabiner, by which the neck pillow can be attached or hung onto a luggage handle, a backpack, or other objects for ease of transport. In a preferred embodiment, the attaching element has a locking means, so as to securely attach the neck pillow to the luggage or other object. In a preferred embodiment, a fastener attachment is provided along the curved outer periphery 12 of the distal ends 26 of each of the legs 20. The fastener attachments, such as a snap or button closure, can be removably coupled together. The fastener attachments may each be located on flat tab projection that extends out from each of the respective distal ends 26 of the legs 20.

Referring now to FIGS. 1, 2A, 2B, 4, and 5A and 5B, which are a left and right side view, respectively, of the neck pillow in accordance with an exemplary embodiment of the application, the casing 40 is constructed of multiple fabrics members sewn together. In a preferred embodiment, the casing is a gusseted design that includes a top fabric member 80, a bottom fabric member 82, and a middle fabric section 84, which runs along the curved outer periphery 12 and curved central inner periphery 14 of the pillow body, and which functions as a gusset to join the top and bottom fabric members 80, 82. The top and bottom fabric members 80, 82 are both semi-circular or U-shaped and of substantially the same size. In a preferred embodiment, the middle fabric section 84 is constructed of four substantially rectangular fabric members 85, 86, 87, 88. The first rectangular fabric member 85 is on the curved inner periphery 14 of the casing between the legs 20. The second and third fabric members 86, 87 are of substantially the same size and are each adjacent to the first rectangular fabric member 85, and on the curved outer periphery 12 of the casing between the medial region 30 and the curved inner periphery 14, each on a respective leg 20. The fourth fabric member 88 is adjacent to and between the second and third fabric members 86, 87 and is along the medial region 30 of the casing.

The fourth fabric member 88 further contains the opening 70, which runs along a length of the fabric member. In a preferred embodiment, the opening 70 may run the entire length of the fabric member 88, thus effectively creating two fabric members separated by the opening. In a preferred embodiment, the opening length is between about 11 inches and 14 inches. In an alternative embodiment, the opening 70 may be on the top or bottom fabric member 80, 82.

In a preferred embodiment, the opening length is 12.5 inches and may range between about 11 inches and 14 inches. The opening is sized to allow for ease in inserting the interior core 60 into the lumen/interior space of the casing without it coming out before the opening is closed. The opening length is proportional to the overall size of the neck pillow 5. Thus, a pillow larger or smaller than the dimension of the preferred embodiment will have proportionally larger or smaller dimensions for the opening.

The gusseted design of the middle fabric section 84 joining the top and bottom fabric members 80, 82 of the casing maintains the semi-circular or U-shape of the neck pillow even when the interior core 60 is composed of a straight-shaped filling or insert, such as the preferred embodiment of the interior core shown in FIG. 7D-1 and described below. The gusset design prevents the neck pillow from substantially distorting from its semi-circular shape when the insert is inserted therein. Additionally, the casing fabric material must have enough structure to hold the U-shape while having enough stretch to fit the pillowcase and topper inside.

In a preferred embodiment, the pillow casing 40 is made of comfortable, breathable materials that are stain resistant and washable. In a preferred embodiment, the top fabric member 80 is a charcoal grey micro-suede polyester microfiber, while the bottom fabric member 82 is a black, fake leather, anti-microbial urethane cast coated polyester knit. The middle fabric section 84 is preferably of the same material as the top fabric member 80, except that the first rectangular fabric member 85 is a breathable polyester mesh material so that the neck area can breathe while in use. The fabrics for the casing 40 can be any of a variety of materials selectable by the ordinary skilled artisan for lining a pillow. Materials suitable for practicing the fabric casing 40 include, but are not limited to, man-made fibers, natural fibers, and combinations thereof, further including cottons, poly/cottons, fleeces, wools, flannels, etc.

Figure 5A:
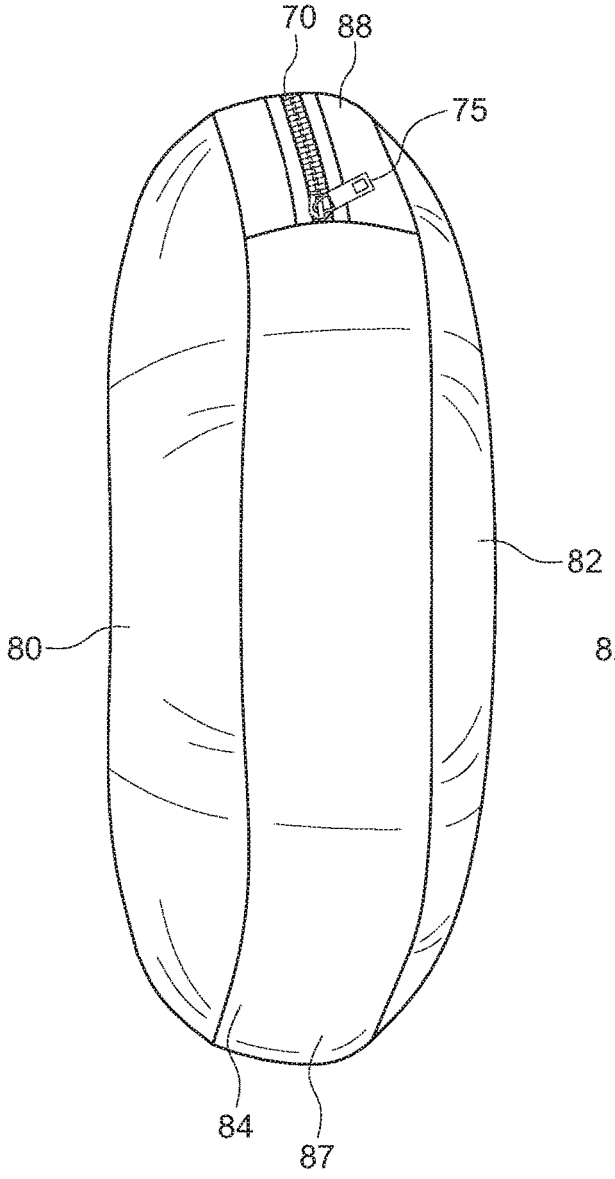
FIG. 5A is a left side view of the neck pillow in accordance with an exemplary embodiment of the application.
Figure 5B:
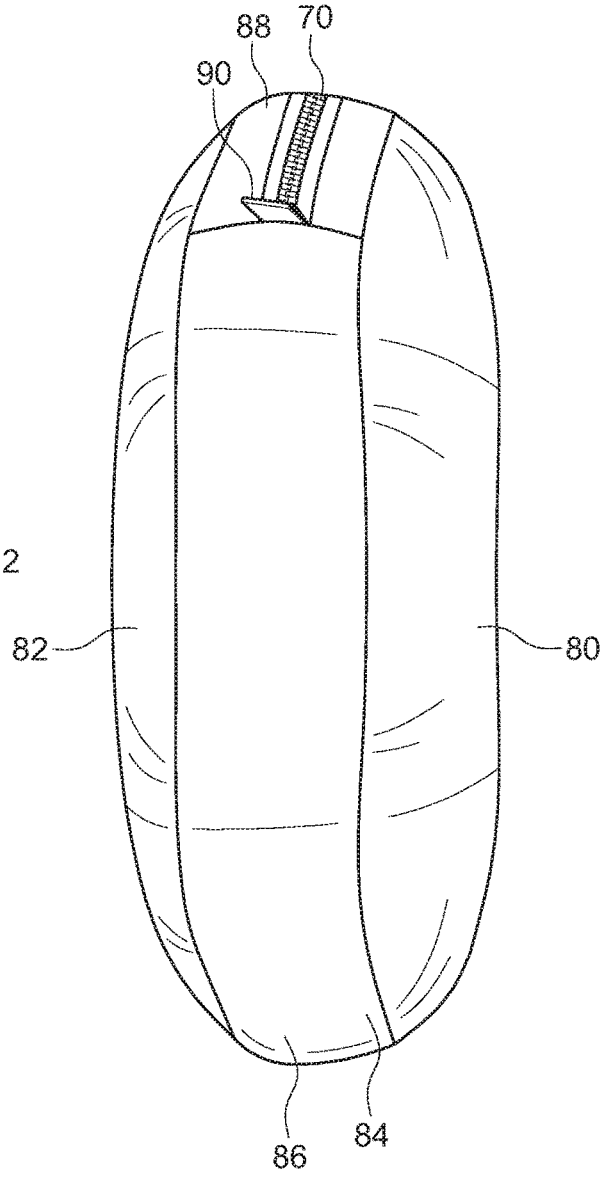
FIG. 5B is a right side view of the neck pillow in accordance with an exemplary embodiment of the application.
Figure 5C:
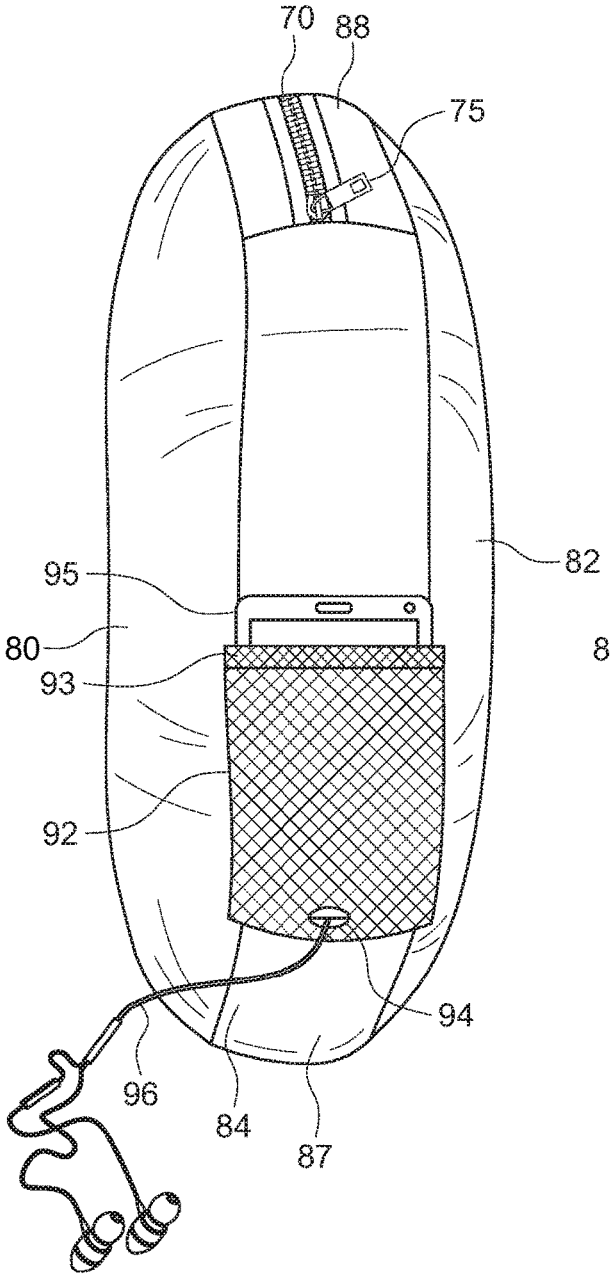
FIG. 5C is a left side view of the neck pillow in accordance with a second exemplary embodiment of the application.
Figure 5D:
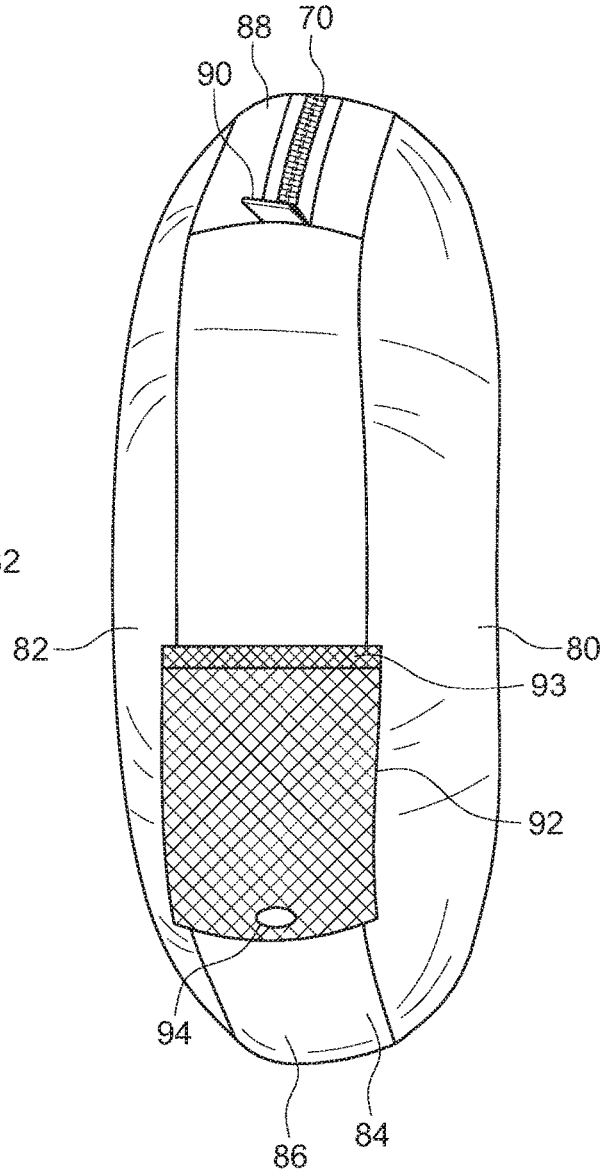
FIG. 5D is a right side view of the neck pillow in accordance with a second exemplary embodiment of the application.

Referring now to FIGS. 5C and 5D, which are a left and right side view, respectively, of the neck pillow in accordance with a second exemplary embodiment of the application, pockets for the storage of items are provided on the left and right sides of the pillow casing 40. (The pockets are not shown in other views disclosed herein.) In a preferred embodiment, a pocket 92 is on the outer periphery 12 of each of the respective legs 20 at or near the distal ends 26. In a preferred embodiment, the pocket is a sleeve pocket composed of a rectangular piece of fabric sewn on three sides to the pillow casing 40, with the unsewn side being an opening 93 to the pocket. The opening 93 may be reversely closeable by a fastener such as a zipper, buttons, snaps, laces, Velcro, or any of a number of means known to one of ordinary skill in the art. In an alternative embodiment, the opening may be lined with elastic such that it can grip in place an object or device 95 contained in the pocket 94. The pocket 92 fabric may be any material appropriate for the fabric members 82, 80, 84 of the casing 40.

The pockets 92 on each leg 20 of the pillow are preferably of equal size and shape for aesthetic purposes, although they may be of any size and shape to accommodate the objects they are intended to store. In a preferred embodiment, the object or device 95 that at least one of the pockets 92 is sized and configured to hold is a smart phone device. Additionally, the pocket may have a small opening 94 at the base of the pocket, such as an eyelet, through which headphones 96 or a similarly corded accessory to the device 95 can be inserted.

Referring now to FIG. 2A, pockets for the storage of items may also be provided on the top fabric member 80 of the pillow casing 40. In a preferred embodiment, a pocket 98 having an opening 99 is on the each of the respective legs 20 at or near the distal ends 26. The structure and function of the pocket 98 is the same as the pocket 92, except that the pocket 98 is smaller and does not have an eyelet opening at its base. In an alternative embodiment, the pocket 98 may also be on the bottom fabric member 82 on the each of the respective legs 20 at or near the distal ends 26.

Figure 6A:
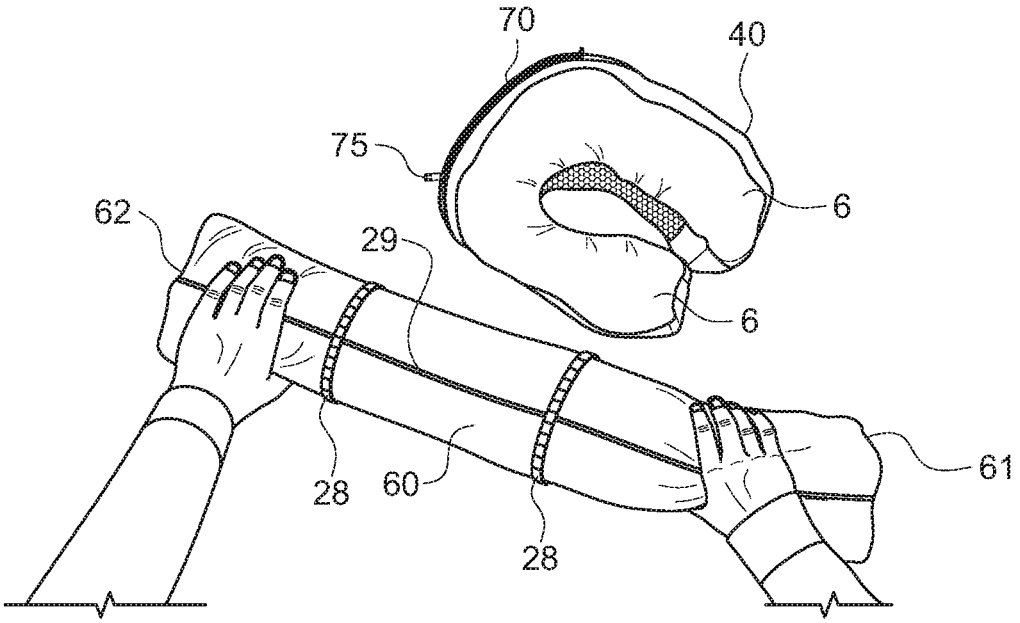
FIGS. 6A-6E show a series of steps for inserting the configurable neck pillow insert into a pillow casing of the neck pillow in accordance with an exemplary embodiment of the application.

Referring now to FIGS. 6A-6E, the operation of the casing is shown. In FIG. 6A, the casing 40 is shown in a collapsed form ready to receive the interior core, in this case, in the preferred embodiment as the configurable pillow case insert in rolled-up form as shown in FIG. 7D-1 and described below. The releasable securing elements 28 have been operated to maintain the insert in the rolled-up form. The Velcro hook strip on the bottom side edge 29 of the insert has secured the rolled-up insert to itself as shown in FIG. 7D-2. The configurable pillow case insert has two ends, 61, 62, each of which will be inserted into the respective legs 20 of the casing 40.

Figure 6B:
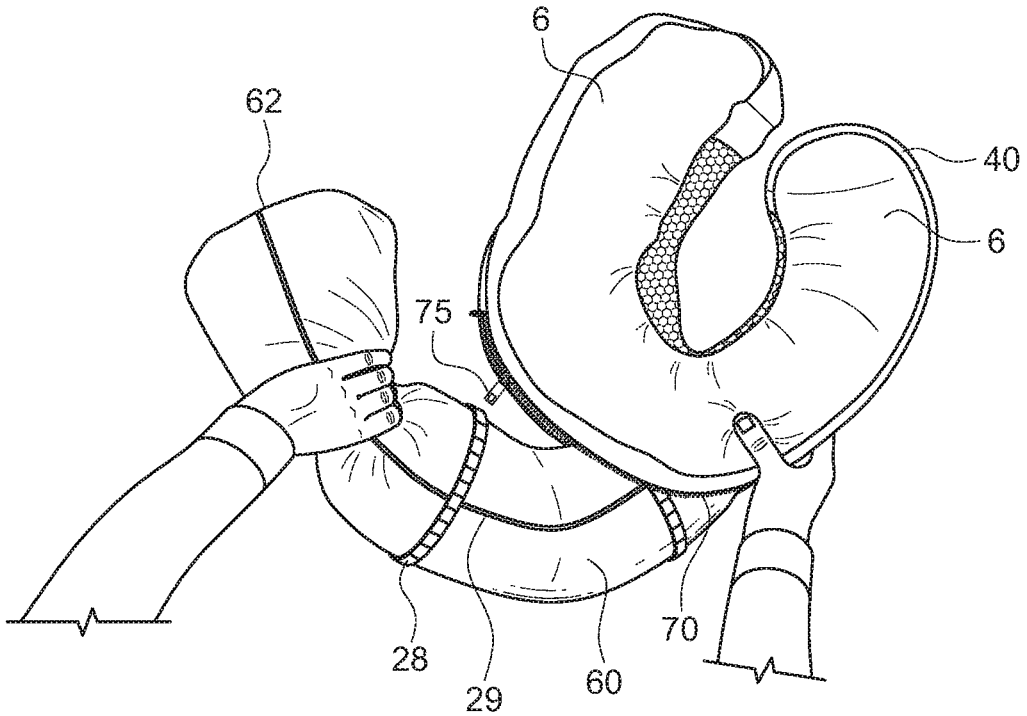
Figure 6C:
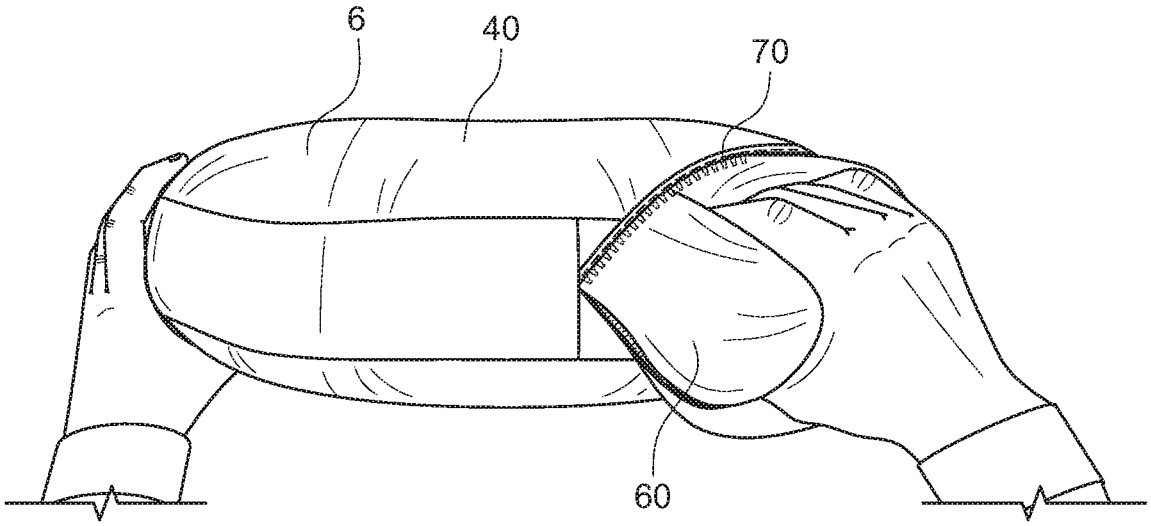
Figure 6D:
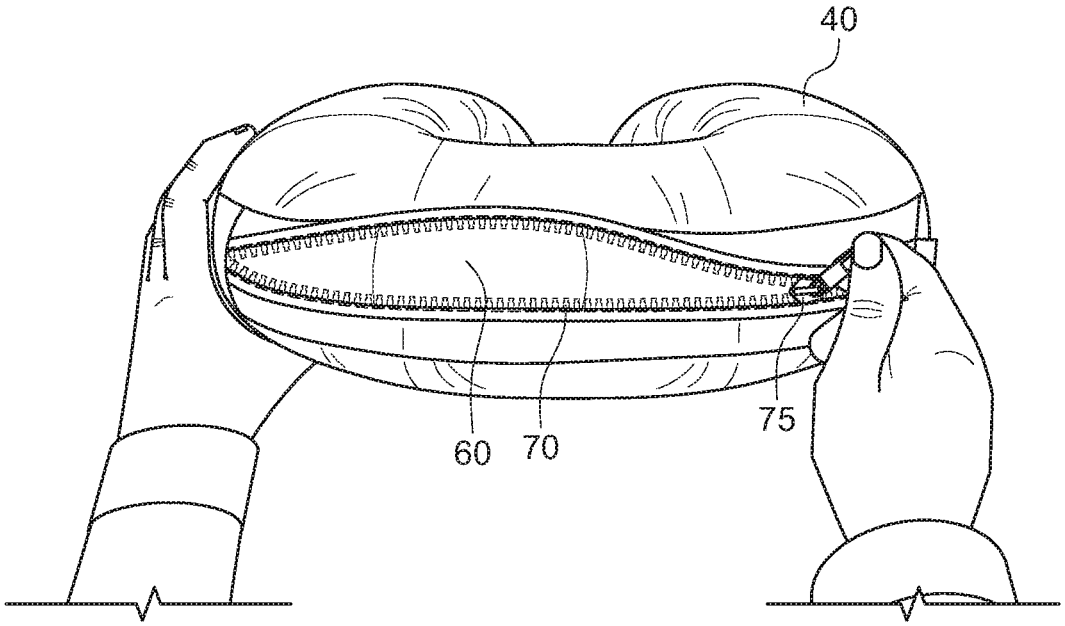
Figure 6E:
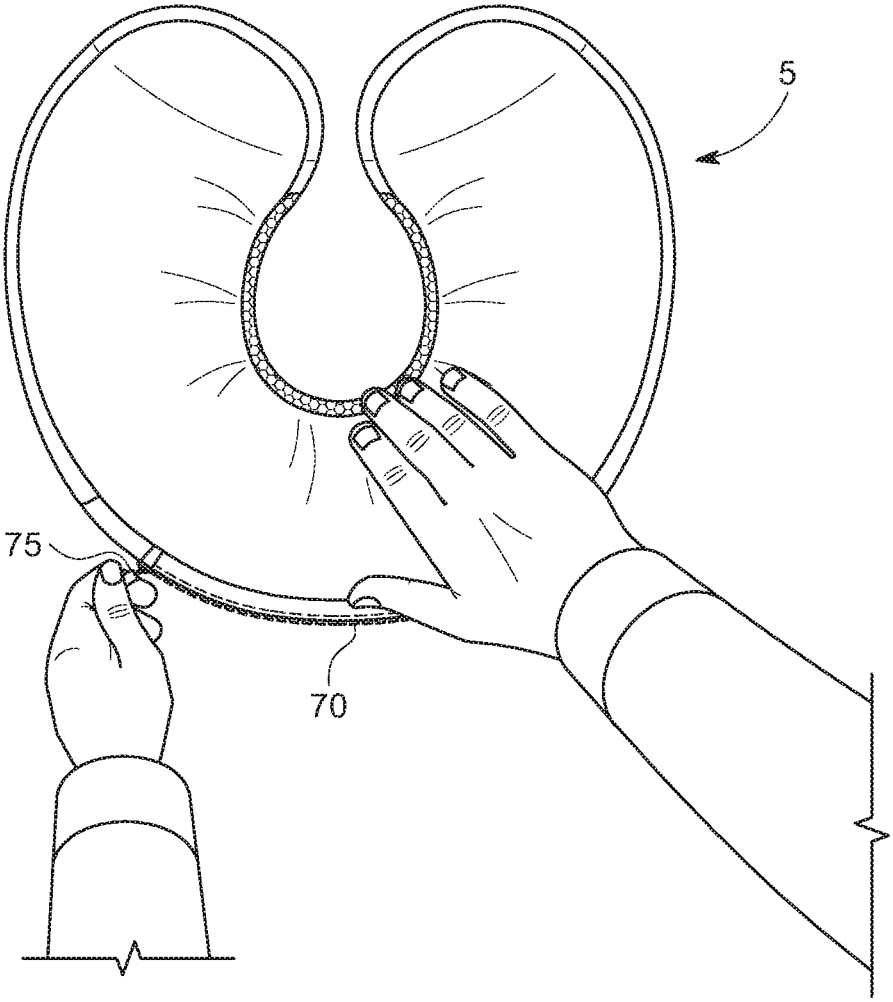

As shown in FIG. 6B, first, one end 61 of the rolled-up configurable pillow case insert 60 is inserted through the unzipped opening 70 of the casing—the fastener 75 being in an unzipped position—into the interior space or lumen 46 of the casing (best seen in FIG. 2), into the first leg 20 of the neck pillow casing 40. (End 61 is not shown because it is already inserted.) Then, as shown in FIG. 6C, the other end 62 of the rolled-up configurable pillow case insert 60 is inserted through the opening 70 of the casing 40 into the second leg 20. Then, as shown in FIG. 6D, the fastener 75 is closed, resulting in the neck pillow 5 ready for use or transport as shown in FIG. 6E.

The configurable pillow case insert 60 may be removed in the same manner in reverse, as shown in FIGS. 6A-6E, and used in its second configuration with a pillow insert as described in FIGS. 7-12.

The preferred embodiment of the interior core 60 as the configurable pillow case of U.S. Pat. No. 9,247,836 is now described in detail.

Referring now to FIG. 7A, a schematic top-down view diagram of a first exemplary embodiment of the configurable pillow case, is shown as a configurable pillow case 10, that includes a housing 12-1 of a size A, with an internally disposed primary compartment 12-2, accessible through an opening 14, that is sized and configured to receive, and releaseably retain therein, a primary insert component (not shown) such as a conventional pillow (or equivalent similarly shaped soft and/or resilient article), and further that includes a secondary compartment 16 of a size B positioned on the pillow case housing 12-1 top surface at distances D1, D2 from the outer edges thereof, that is operable to receive and releaseably retain therein, at least one secondary insert component 20 of a size C (shown by way of example only, as a single insert component), which may comprise at least one of the following materials: memory foam, latex foam, memory gel, gel, fluid, a granular mixture, at least one inflatable air bladder, a rubberized component, a selectively shapeable material component (for example, pluckable soft foam), a feather filled component, a down filled component, and/or a resilient material component or assembly.

In accordance with the present application, the relative sizes A, B, and C, and the distances D1, D2, may be selected as a matter of design choice or convenience without departing from the spirit of the application. In one embodiment of the present application in which the configurable pillow case 10 is sized and configured for use with conventionally sized sleeping pillows, the value of secondary component 16 size B is preferably substantially equals or exceeds the value of the pillow case housing 12-1 size A.

Referring now to FIG. 7B, a schematic side view diagram of the configurable pillow case 10 of FIG. 7A is shown by way of example only, with an exemplary primary insert component (e.g., a pillow) 22 positioned in the configurable pillow case primary compartment 12-2, and the exemplary secondary insert component 20; positioned in the secondary compartment 16.

Referring now to FIG. 7C, a schematic side view diagram of the configurable pillow case 10 of FIG. 7A is shown by way of example only, with an empty primary compartment 12-2, and with the exemplary secondary insert component 20 being positioned in the secondary compartment 16.

Referring now to FIG. 7D-1, a schematic isometric view diagram of the configurable pillow case 10 of FIG. 7A is shown, by way of example only, in a "rolled-up" mode suitable for transport, storage, travel, and for various alternative uses, such as a bolster, lumbar, and/or neck support pillow, as described above and shown in FIGS. 1-6. Optionally, the configurable pillow case 10 further includes at least one releasable securing element 28 (e.g., an elastic or other type of a band or a strap operable to maintain the configurable pillow case 10 in the rolled-up mode.

Figures 3, 7D:
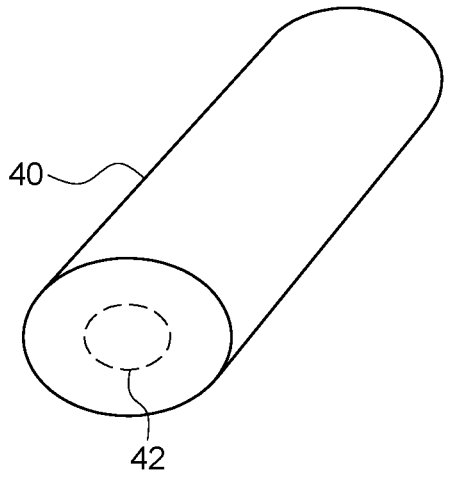

Referring now to FIG. 7D-3, a schematic isometric view diagram of the configurable pillow case 10 rolled up mode view of FIG. 7D-1 is shown, by way of example only, as positioned within an optional outer housing 40 (which may be a suitably sized sleeve, bag, case or equivalent), which may include an optional securing element 42, such as a drawstring or other type of closure (zipper, etc.) operable to retain the rolled up configurable pillow case 10 within the outer housing 40.

Figure 8A:
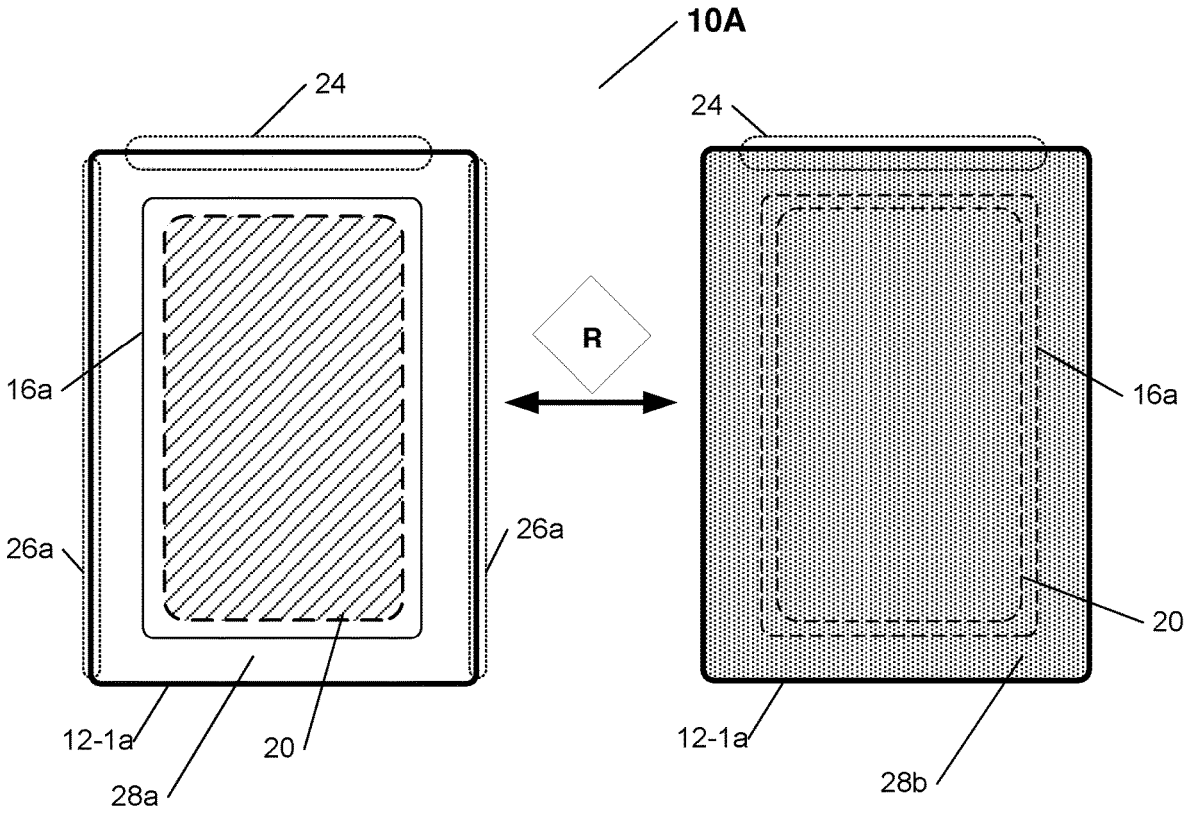
FIG. 8A is a schematic top-down view diagram of a first alternative embodiment of the configurable pillow case of FIG. 7A.

Referring now to FIG. 8A, a schematic top-down view diagram of a first alternative embodiment of the configurable pillow case 10 of FIG. 7A, is shown as a configurable pillow case 10A with a housing 12-1*a* that comprises a first lining 28*a*, suitable for a first category of configurable pillow case 10A use (such as for sleeping thereon), and a second lining 28*b*, suitable for a secondary category of configurable pillow case 10A use (such as for transporting, for utilization in a rolled up mode, etc.), which may comprise a protective/rugged material, such as nylon, polyester, etc. Advantageously, the configurable pillow case 10A is further configured to be capable of reversible operation R either by inversion (or by using optional selectively operable reversibility facilitating elements 26*a* (such as side zippers or equivalent) such that in a "reversed" mode of operation, the novel configurable pillow case 10A is configured such that its primary compartment inner surface 28*b* comprises the pillow case 10A outer surface, while the pillow case outer surface 28*a* comprises the inner surface of a newly formed primary compartment, and such that the secondary compartment 16*a* is positioned inside the newly formed primary compartment, underneath the pillow case 10A new top surface 28*b*.

Figure 8B:
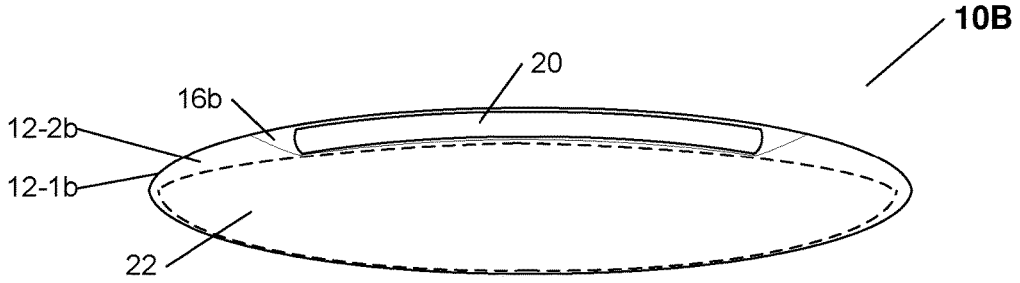
FIG. 8B is a schematic side-view diagram of a second alternative embodiment of the configurable pillow case of FIGS. 7A and 7B and is also a schematic side-view diagram of the configurable pillow case of FIG. 8A.

Referring now to FIG. 8B, a schematic side-view diagram of a second alternative embodiment of the configurable pillow case 10 of FIGS. 7A and 7B, is shown as a configurable pillow case 10B with components 12-1*b*, 12-2*b*, 16*b*, 20 and 22, in which the secondary compartment 16*b* is positioned within the primary compartment 12-2*b*, below the top outer surface of the novel configurable pillow case 12-1*b*, so as to enable the configurable pillow case 10B to aesthetically appear as a conventional pillow case even when an exemplary primary insert component 20 is placed therein, above the compartment with the pillow 22. This FIG. 8B also illustrates the configurable pillow case 10A of FIG. 8A, in its reversed (inverted) mode of operation, with the insert component 20 positioned in the primary compartment.

Figure 9A:
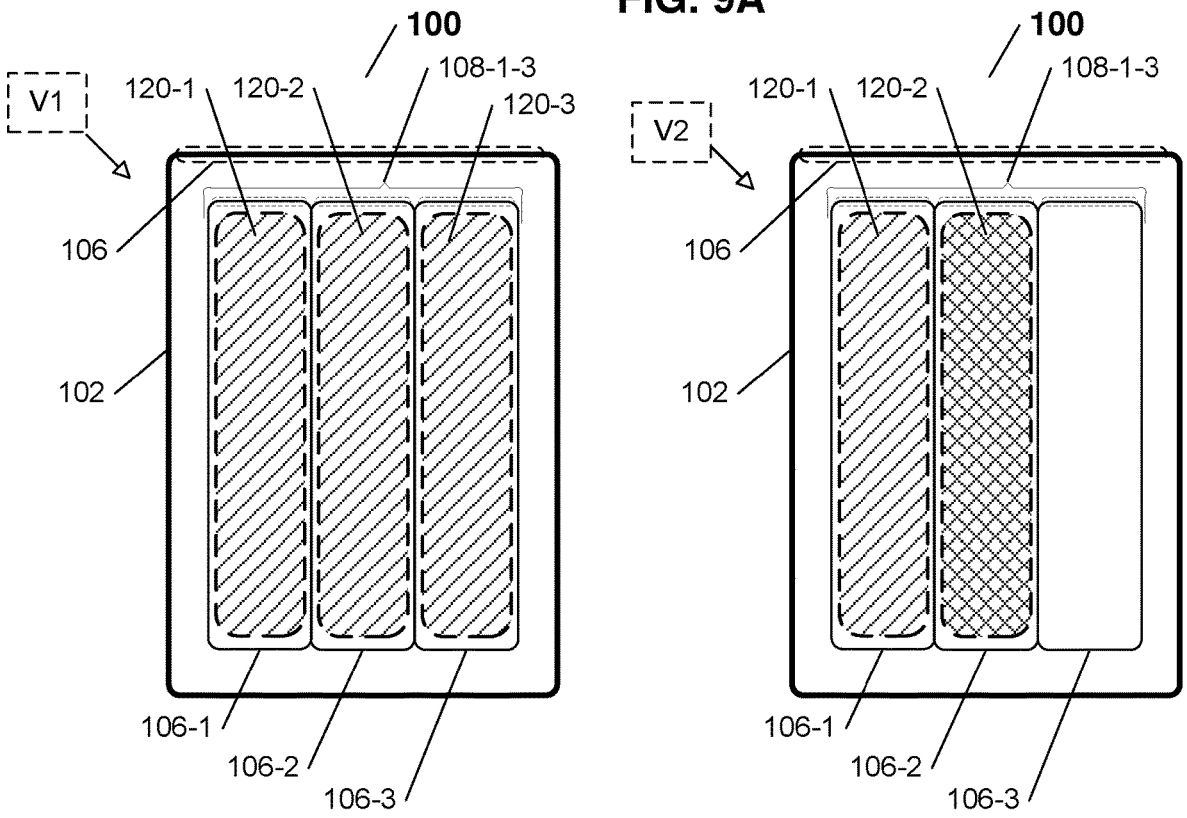
FIG. 9A is a schematic top-down view diagram of a second exemplary embodiment of the configurable pillow case.

Referring now to FIG. 9A, a schematic top-down view diagram of a second exemplary embodiment of the configurable pillow case, is shown as a configurable pillow case 100, with an internally disposed primary compartment 102, and a secondary compartment region 108-1 to 108-3, positioned on the pillow case 100 top surface, that includes a plurality of individual proximally disposed secondary compartments (at least two, with three compartments 106-1 to 106-3 being illustrated by way of example only) positioned therein, with the primary compartment 102 being operable to receive through an opening 106 and releaseably retain therein any primary insert component (such as an appropriately sized conventional pillow (or equivalent similarly shaped soft and/or resilient article)), and with each plural secondary compartment 106-1 to 106-3 being selectively operable to receive, and retain therein, at least one corresponding secondary insert component (such as a memory foam, latex, resilient material filled, inflatable, or other type of resilient article), such as at least one insert component 120-1 to 120-3, where: in a view V1, all three exemplary plural secondary compartments 106-1 to 106-3 are shown, by way of example, with corresponding plural secondary insert components 120-1 to 120-3, disposed therein; and in a view V2, the three exemplary plural secondary compartments 106-1 to 106-3 are shown, by way of example, with corresponding plural secondary inserts 120-1 and 120-2 disposed in only two of the three plural secondary compartments.

Figure 9B:
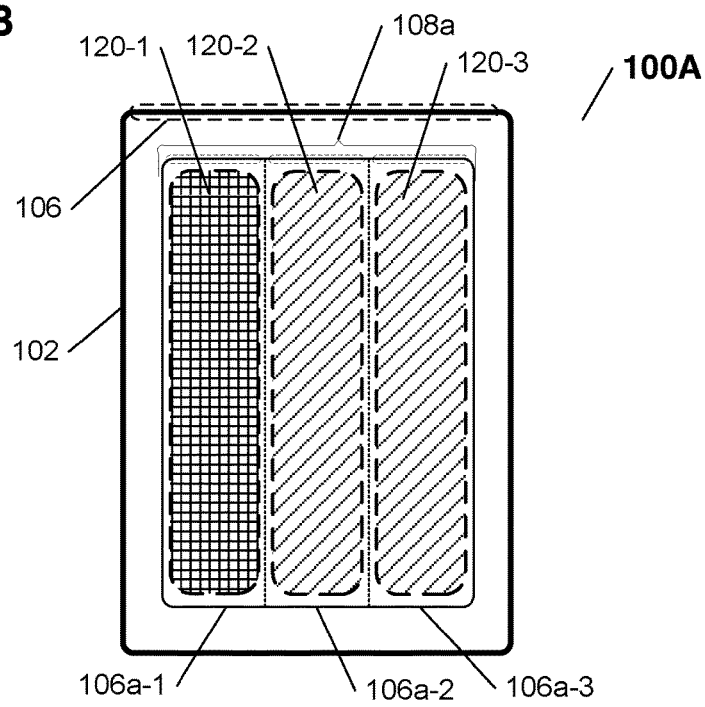
FIG. 9B is a schematic top-down view diagram of an alternative embodiment of the configurable pillow case of FIG. 9A.

Referring now to FIG. 9B, a schematic top-down view diagram of an alternative embodiment of the configurable pillow case 100 of FIG. 9A, is shown as a configurable pillow case 100A with an internally disposed primary compartment 102, and a multi-section secondary compartment 108*a* positioned on the pillow case top surface, that includes a plurality of secondary compartment sections (at least two, with three compartment sections 106*a*-1 to 106*a*-3 being illustrated by way of example only) internally disposed therein, with the primary compartment 102 being operable to receive and releaseably retain therein any primary insert component (such as an appropriately sized conventional pillow (or equivalent similarly shaped soft and/or resilient article)) through an opening 106, and with each plural secondary compartment section 106*a*-1 to 106*a*-3 being selectively operable to receive and retain at least one corresponding secondary insert component 120-1 to 120-3 (such as a memory foam, latex, resilient material filled, inflatable, or other type of resilient article).

Figure 10:
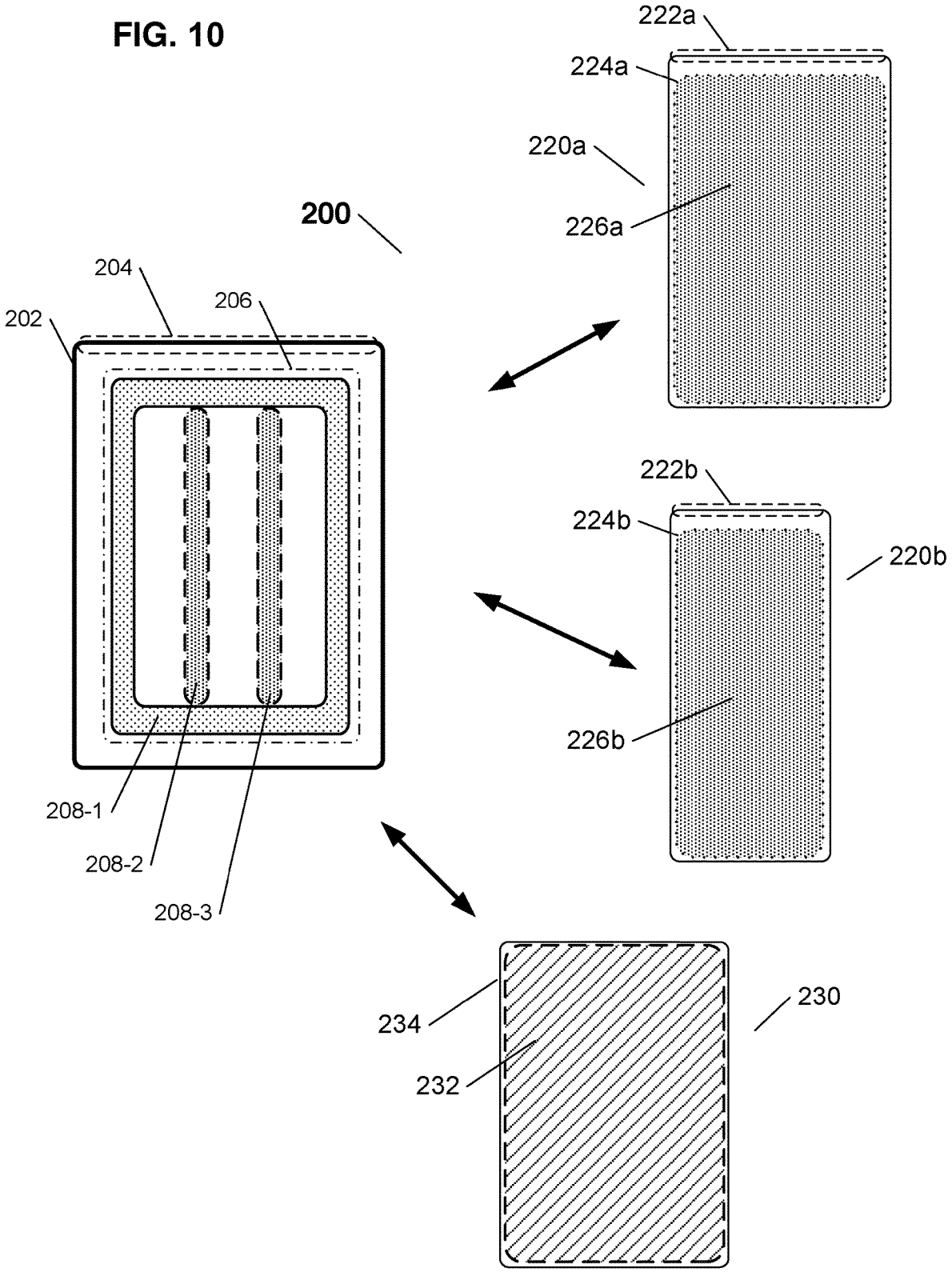
FIG. 10 is a schematic top-down view diagram of a third exemplary embodiment of the configurable pillow case.

Referring now to FIG. 10, a schematic top-down view diagram of a third exemplary embodiment of the configurable pillow case, is shown as a configurable pillow case 200, with an internally disposed primary compartment 202, and a secondary compartment attachment region 206 positioned on the pillow case 200 top surface, that includes a predefined pattern of at least one releasable attachment elements (up to three such elements 208-1 to 208-3 are shown by way of example), operable to selectively and releaseably connect to, and retain, at least one separate secondary compartment 220*a* (that may be provided empty and/or supplied with an internally disposed predefined secondary insert component 224*a*), that includes corresponding attachment elements 226*a* positioned thereon operable to releasably connect to elements 208-1 to 208-3, for example if configured with hook and loop materials, with the primary compartment 202 being operable to receive and releaseably retain therein any primary insert component (such as an appropriately sized conventional pillow (or equivalent similarly shaped soft and/or resilient article)) through an opening 204. The separate at least one secondary compartment 220*a* is selectively operable to receive, and retain therein through an opening 222*a*, at least one corresponding secondary insert component 224*a* (such as a memory foam, latex, resilient material filled, inflatable, or other type of resilient article). Alternately, the releasably attachable secondary compartment 220*a* may comprise a different size and/or shape compartment 220*b*, with correspondingly sized attachment elements 226*b* positioned on the underside thereof, and having a corresponding insert 224*b* positioned therein. Alternately, instead of a secondary compartment 220*a*, an integrated comfort component 230, which comprises a secondary insert component 232 covered in a material 234 that is configurable to releasably attach to the releasable attachment elements 208-1 to 208-3 of the pillow case 200.

Figure 11A:
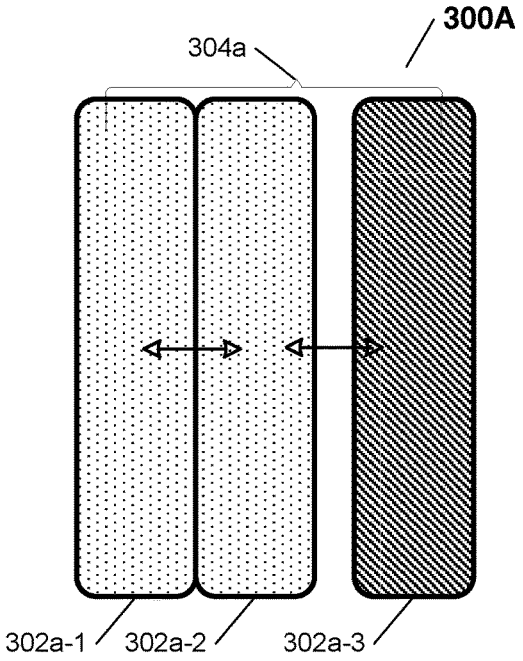
FIG. 11A is a schematic top-down view diagram of a first exemplary embodiment of the secondary insert component for use in conjunction with any of the various embodiments of the configurable pillow case of FIGS. 7A to 10.

Referring now to FIG. 11A, a schematic top-down view diagram of a first exemplary embodiment of the secondary insert component for use in conjunction with any of the various embodiments of the configurable pillow case of FIGS. 7A to 10, is shown as a modular secondary insert component 300A, that includes a plurality of proximal insert modules 304*a* (with three modules being shown by way of example only), each plural insert module that includes at least one releasable attachment element 302*a*-1 to 302*a*-3 that is selectively operable for releasable attachment of each insert module to at least one other plural insert module (thus enabling the novel modular secondary insert component 300 to be configured in a variety of different desired arrangements, prior to insertion thereof into one or more of the corresponding secondary compartment(s) of the various embodiments of the configurable pillow case of the present application.

Figure 11B:
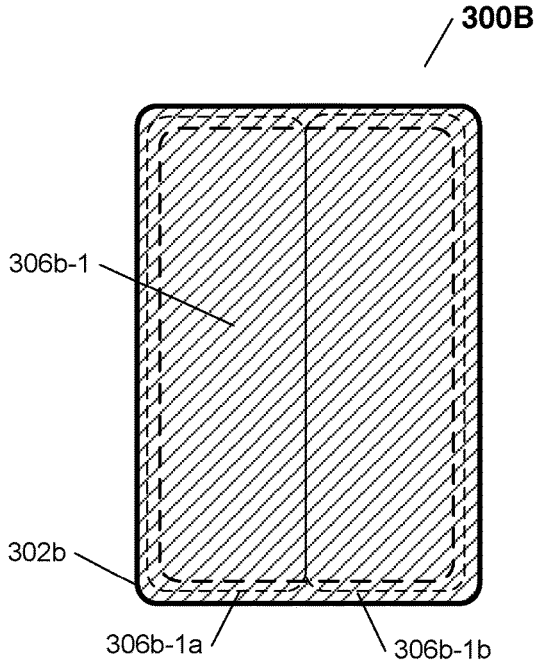
FIG. 11B is a schematic top-down view diagram of a second exemplary embodiment of the secondary insert component for use in conjunction with any of the various embodiments of the configurable pillow case of FIGS. 7A to 10.

Referring now to FIG. 11B, a schematic top-down view diagram of a second exemplary embodiment of the secondary insert component for use in conjunction with any of the various embodiments of the configurable pillow case of FIGS. 7A to 10, shown as a secondary insert component 300B, that includes a plurality of predefined regions and/or compartments 302*b* to 306*b*-1*b*, each having different physical characteristics, parameters, and/or predefined function (s), sized and configured for insertion thereof into one or more of the corresponding secondary compartment(s) of the various embodiments of the configurable pillow case of the present application.

Figure 11C:
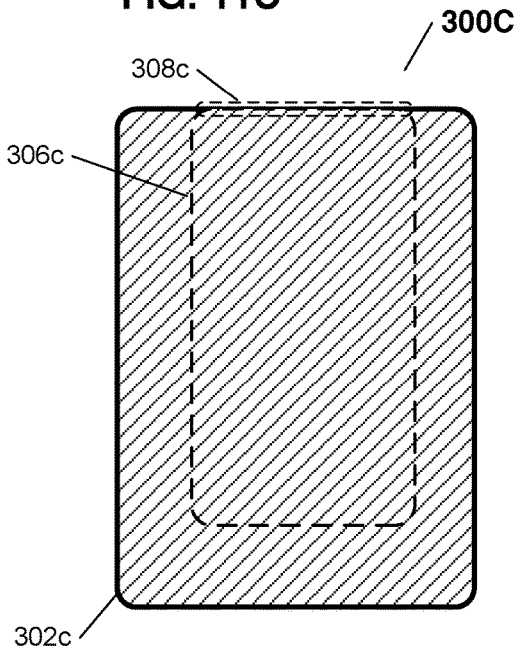
FIG. 11C is a schematic top-down view diagram of a third exemplary embodiment of the secondary insert component for use in conjunction with any of the various embodiments of the configurable pillow case of FIGS. 7A to 10.

Referring now to FIG. 11C, a schematic top-down view diagram of a third exemplary embodiment of the secondary insert component for use in conjunction with any of the various embodiments of the configurable pillow case of FIGS. 7A to 10, shown as a secondary insert component 300C that includes a body 302*c* having at least one hollow internal cavity 306*c* accessible by a user through an opening 308*c*, operable to receive one or more appropriately sized and shaped articles therein (through the opening 308*c*), while enabling the novel secondary insert component 300A to substantially maintain its outer shape and dimensions sufficiently to permit the insertion thereof into one or more of the corresponding secondary compartment(s) of the various embodiments of the configurable pillow case of the present application.

Figure 11D:
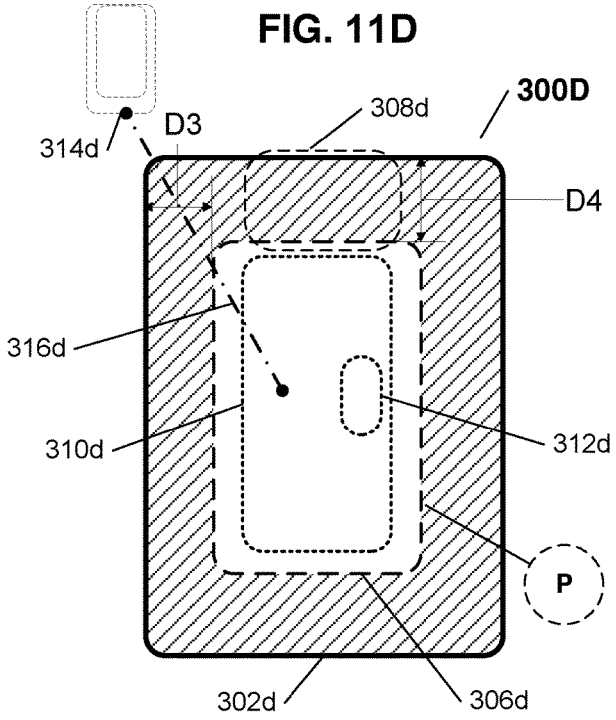
FIG. 11D is a schematic top-down view diagram of an alternative exemplary embodiment of the secondary insert component of FIG. 11C, for use in conjunction with any of the various embodiments of the configurable pillow case of FIGS. 7A to 10.

Referring now to FIG. 11D, a schematic top-down view diagram of an alternative exemplary embodiment of the secondary insert component 300C of FIG. 11C, is shown as secondary insert component 300D for use in conjunction with any of the various embodiments of the configurable pillow case of FIGS. 7A to 10, that includes a body 302*d* having at least one hollow internal cavity 306*d* therein, and further that includes at least one functional element 310*d* disposed therein, that is selectively operable (by a user and/or automatically) to perform one or more predefined functions, each function being controllable by: (a) at least one corresponding local control element 312*d* positioned within and/or on the secondary insert component (configured for direct and/or automatic control of the predefined function(s)), (b) by a remote control P located outside of the secondary insert component 300D; and/or (c) by a data processing device 314*d* (such as a mobile communication device (e.g., smart phone), and or a portable or desktop computer) through a wireless communication link 316*d*, where each at least one functional element 310*d* (and, if applicable, at least one control element 312*d*) is sized and configured (for example at least through selection of dimensions D3 and D4), to enable the novel secondary insert component 300D to substantially maintain its outer shape and dimensions sufficiently to permit the insertion thereof into one or more of the corresponding secondary compartment(s) of the various embodiments of the configurable pillow case of the present application.

Optionally an opening in the insert body 302*d*, enabling access to the internal cavity 306*d*, may comprise a removable insert 308*d* that enables the at least one functional element 310*d* to be retained within the internal cavity 306*d* during use of the secondary insert component 300D, but to be easily removed when desired by first removing the insert 308*d*.

Thus, while there have been shown and described and pointed out fundamental novel features of the head and neck pillow as applied to preferred embodiments thereof, it will be understood that various omissions and substitutions and changes in the form and details of the head and neck pillows illustrated, and in their operation, may be made by those skilled in the art without departing from the spirit of the disclosure. For example, it is expressly intended that all combinations of those elements and/or method steps which perform substantially the same function in substantially the same way to achieve the same results are within the scope of the application. It is the intention, therefore, to be limited only as indicated by the scope of the claims appended hereto.

What is claimed is:

1. A pillow comprising:

a substantially u-shaped pillow body having a medial region and a pair of legs that extend from the medial region to define an opening therebetween, the pillow body comprising:

a casing defining an exterior surface and interior surface of the pillow body, the interior surface defining a lumen of the pillow body, the lumen being a single continuous interior compartment, the casing further defining a top side, a bottom side, a curved outer periphery, and a curved inner periphery of the pillow body, the casing comprising:

a top fabric member on the top side of the casing, the top fabric member having a first edge, a bottom fabric member on the bottom side of the casing, the bottom fabric member having a second edge, the top and bottom fabric members both substantially u-shaped and substantially the same size, and a middle fabric section having a top edge and a bottom edge, the middle fabric section running along the curved outer periphery and curved inner periphery of the casing, and attached along the top edge to the first edge of the top fabric member, and attached along the bottom edge to the second edge of the bottom fabric member, wherein the middle fabric section further comprises a first, second, third and fourth rectangular fabric members, the first rectangular fabric member running along the curved inner periphery of the casing between the legs, the second and third rectangular fabric members adjacent to, and attached to, the first rectangular fabric member, and running along the curved outer periphery of the casing between the medial region and the curved inner periphery, each along a respective leg, and the fourth rectangular fabric member adjacent to, and attached to, the second and third rectangular fabric members, and running along the medial region, and an interior core disposed within the lumen, the interior core comprising a flexible insert in a rolled up configuration that substantially fills the interior core, wherein the middle fabric section of the casing, including first, second, third and fourth rectangular fabric members thereof, is configured to substantially maintain the substantially u-shape of the pillow body and prevent the pillow body from distorting from the substantially u-shape when the flexible insert has been inserted therein.

2. The pillow of claim 1, wherein the flexible insert comprises at least one of: a memory foam component, a latex foam component, a memory gel component, a granular mixture, at least one inflatable bladder, a rubberized component, a selectively shapeable component, a feather filled component, a down filled component, and a resilient material component or assembly.

3. The pillow of claim 1, wherein the flexible insert comprises a configurable pillow case insert comprising:

a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

4. The pillow of claim 3, further comprising a primary insert and at least one secondary insert, wherein the primary insert comprises a conventional pillow and wherein the at least one secondary insert comprises at least one of: a memory foam component, a latex foam component, a memory gel component, a granular mixture, at least one inflatable bladder, a rubberized component, a selectively shapeable material component, a feather filled component, a down filled component, and a resilient material component or assembly.

5. The pillow of claim 1, wherein the pillow body further comprises an opening on the casing through which the lumen is accessible and into which the flexible insert may be received and releasably retained therein.

6. The pillow of claim 1, wherein the flexible insert is operable in a first configuration in which the flexible insert is in a rolled up configuration and is generally cylindrical shaped before it is received by the lumen, and wherein the flexible insert is further operable in a second configuration in which the flexible insert is in an unrolled form and the primary insert is a conventional pillow.

7. A pillow comprising:

a substantially u-shaped pillow body having a medial region and a pair of legs that extend from the medial region to define an opening therebetween, the pillow body comprising:

a casing defining an exterior surface and interior surface of the pillow body, the interior surface defining a lumen of the pillow body, the lumen being a single continuous interior compartment, the casing further defining a top side, a bottom side, a curved outer periphery, and a curved inner periphery of the pillow body, the casing comprising:

a top fabric member on the top side of the casing, the top fabric member having a first edge, a bottom fabric member on the bottom side of the casing, the bottom fabric member having a second edge, the top and bottom fabric members both substantially u-shaped and substantially the same size, and a middle fabric section having a top edge and a bottom edge, the middle fabric section running along the curved outer periphery and curved inner periphery of the casing, and attached along the top edge to the first edge of the top fabric member, and attached along the bottom edge to the second edge of the bottom fabric member, wherein the middle fabric section further comprises:

a first, second, third and fourth rectangular fabric members, the first rectangular fabric member running along the curved inner periphery of the casing between the legs, the second and third rectangular fabric members adjacent to, and attached to, the first rectangular fabric member, and running along the curved outer periphery of the casing between the medial region and the curved inner periphery, each along a respective leg, and the fourth rectangular fabric member adjacent to, and attached to, the second and third rectangular fabric members, and running along the medial region, and an interior core disposed within the lumen, the interior core comprising a resilient material component that substantially fills the interior core, wherein the resilient material component further comprises a flexible insert in a rolled up configuration, wherein the middle fabric section of the casing, including first, second, third and fourth rectangular fabric members thereof, is configured to substantially maintain the substantially u-shape of the pillow body and prevent the pillow body from distorting from the substantially u-shape when the flexible insert has been inserted therein.

8. The pillow of claim 7, wherein the flexible insert comprises a configurable pillow case insert comprising: a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

9. The pillow of claim 7, wherein the flexible insert comprises a configurable pillow case insert comprising: a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

10. The pillow of claim 9, further comprising a primary insert and at least one secondary insert, wherein the primary insert comprises a conventional pillow and wherein the at least one secondary insert comprises at least one of: a memory foam component, a latex foam component, a memory gel component, a granular mixture, at least one inflatable bladder, a rubberized component, a selectively shapeable material component, a feather filled component, a down filled component, and a resilient material component or assembly.

11. The pillow of claim 7, wherein the pillow body further comprises an opening on the casing through which the lumen is accessible and into which the flexible insert may be received and releasably retained therein.

12. The pillow of claim 7, wherein the flexible insert is operable in a first configuration in which the flexible insert is in a rolled up configuration and is generally cylindrical shaped before it is received by the lumen, and wherein the flexible insert is further operable in a second configuration in which the flexible insert is in an unrolled form and the primary insert is a conventional pillow.

13. A pillow comprising:

a substantially u-shaped pillow body having a medial region and a pair of legs that extend from the medial region to define an opening therebetween, the pillow body comprising:

a casing defining an exterior surface and interior surface of the pillow body, the interior surface defining a lumen of the pillow body, the lumen being a single continuous interior compartment, the casing further defining a top side, a bottom side, a curved outer periphery, and a curved inner periphery of the pillow body, the casing comprising:

a top fabric member on the top side of the casing, the top fabric member having a first edge, a bottom fabric member on the bottom side of the casing, the bottom fabric member having a second edge, the top and bottom fabric members both substantially u-shaped and substantially the same size, and a middle fabric section which functions as a gusset to join the top and bottom fabric members, the middle fabric section having a top edge and a bottom edge, the middle fabric section running along the curved outer periphery and curved inner periphery of the casing, and attached along the top edge to the first edge of the top fabric member, and attached along the bottom edge to the second edge of the bottom fabric member, wherein the middle fabric section further comprises a first, second, third and fourth rectangular fabric members, the first rectangular fabric member running along the curved inner periphery of the casing between the legs, the second and third rectangular fabric members adjacent to, and attached to, the first rectangular fabric member, and running along the curved outer periphery of the casing between the medial region and the curved inner periphery, each along a respective leg, and the fourth rectangular fabric member adjacent to, and attached to, the second and third rectangular fabric members, and running along the medial region, and an interior core disposed within the lumen, the interior core comprising a flexible insert in a rolled up configuration that substantially fills the interior core, wherein the middle fabric section of the casing, including first, second, third and fourth rectangular fabric members thereof, is configured to substantially maintain the substantially u-shape of the pillow body and prevent the pillow body from distorting from the substantially u-shape when the flexible insert has been inserted therein.

14. The pillow of claim 13, wherein the flexible insert comprises at least one of: a memory foam component, a latex foam component, a memory gel component, a granular mixture, at least one inflatable bladder, a rubberized component, a selectively shapeable component, a feather filled component, a down filled component, a resilient material component or assembly, and a configurable pillow case insert comprising a housing having a top surface, a bottom surface, and a plurality of side edges, a primary compartment disposed within the housing, sized and configured to receive a primary insert therein, and at least one secondary compartment, positioned in at least one predetermined region of the housing, proximal to the top surface thereof, each configured to receive, and releasably retain therein, an at least one secondary insert.

15. The pillow of claim 13, wherein each of the legs further comprises a distal end, wherein the distal ends are caused to be biased toward each other to maintain the substantially u-shape of the pillow body only by the function of the gusset.

* * * * *